US005090325A

United States Patent [19]

Saito et al.

[11] Patent Number: 5,090,325

[45] Date of Patent: Feb. 25, 1992

[54] TUNNEL DRIVING METHOD

[75] Inventors: Takeo Saito, Tokyo; Yoshiaki Ishida, Saitama; Nobuyuki Fukunaga, Toyama; Mutsuhiko Kimura, Aichi; Yasuo Metoki, Ibaraki, all of Japan

[73] Assignee: Sato Kogyo Co., Ltd., Toyama, Japan

[21] Appl. No.: 718,306

[22] Filed: Jun. 17, 1991

[51] Int. Cl.[5] ..... F42B 3/00; E21B 43/116

[52] U.S. Cl. ..... 102/313; 102/312; 175/4.52

[58] Field of Search ..... 102/312, 313; 175/4.5, 175/4.51, 4.52, 4.57

[56] References Cited

U.S. PATENT DOCUMENTS

| | | | |
|---|---|---|---|
| 2,151,328 | 3/1939 | Noble | 262/8 |
| 3,104,584 | 9/1963 | Jacobs | 86/20 |
| 3,338,317 | 8/1967 | Shore | 175/4.51 |
| 3,635,293 | 1/1972 | Desty et al. | 175/4.5 |
| 4,522,129 | 6/1985 | Jerberyd | 175/4.5 X |
| 4,544,034 | 10/1985 | George | 175/4.52 X |
| 4,583,602 | 4/1986 | Ayers | 175/4.52 |
| 4,619,333 | 10/1986 | George | 175/4.52 |
| 4,984,520 | 1/1991 | Aseltine et al. | 102/313 |

*Primary Examiner*—Peter A. Nelson

*Attorney, Agent, or Firm*—Lowe, Price, LeBlanc & Becker

[57] ABSTRACT

A tunnel driving method using a drill carriage provided with plural number of drill booms having drifters. According to a preferred embodiment, while the drill carriage is placed before a bench, the charging cages are moved to mark blasting holes and rock bolt holes for an upper portion. While the drill carriages are moved backward with a predetermined length, the charging cages are moved to insert the rock bolts for the upper portion. Simultaneously, the charging cages are operated in a lower portion to bore blasting holes for the lower portion. Then, the charging cages are operated to charge the blasting holes for the upper portion and the lower portion with dynamite for blasting so that the facing is broken and a new facing is formed. Subsequently, after first and second operation of concrete shooting, the above continuous operation is performed repeatedly.

5 Claims, 34 Drawing Sheets

TUNNEL DRIVING METHOD

BACKGROUND OF THE INVENTION

1. Field of the Invention

This invention relates to a tunnel driving method applied in NATM methods.

2. Prior Art

For tunnel driving and tunnel self-sustenance, NATM methods are conspicuous in these days.

As the NATM methods, there can be mentioned following methods.

(1) a full face cutting method

With this method, the full face of a tunnel is driven at once. Then, the method can be performed only when natural ground is stable.

(2) a long bench cut method

This method is performed when the length of a bench is generally longer than 50 m, natural ground is comparatively stable and invert closure should not be carried out so quickly. Further, this method includes two ways. One way is a simultaneous driving for the upper and lower portions of an inner section. Another way is an alternate driving for the upper and lower portions.

(3) a short bench cut method

This method is performed when the length of a bench is generally about from 15 to 30 m. This method is carried out with blasting treatment or mechanical treatment.

(4) a minibench cut method

This method is originally performed when invert closure should be carried out quickly due to unstable natural ground and/or the natural ground having large possibility of swelling. Actually, this method is seldom executed.

(5) a multistage bench cut method

If a tunnel has a comparatively large cross section, the facing of the tunnel can not self-sustain by normal bench cut methods. In this case, this multistage bench cut method can be used.

(6) a silot method

This method is performed when the face of a tunnel is comparatively large and natural ground does not have enough supporting strength against tunnel driving. Further, this method is often utilized in driving for town tunnels in order to prevent the settlement of the natural ground.

Next, from the view point of operation for driving a tunnel, the prior art will be explained. The conventional operation with drifters in the bench cut methods, particularly in the bench cut methods where the upper portion of the inner section is treated in prefer to the lower portion of the inner section, will be explained referring to FIG. 42. In the conventional operation, two drill carriages D, D are required. Each drill carriage D has two drill booms and one charging cage. The drill carriages D, D are placed on an upper stage U at its both sides with respect to the axis of a tunnel. First, blasting holes and rock bolt holes are marked with the charging cage. Next, as shown in FIG. (A), one rock bolt hole is bored with one drill boom of each drill carriage D. At the same time, one blasting hole of the upper portion is bored with another drill boom. Then, as shown in FIG. (B), rock bolts are inserted into the top and bottom of the upper portion with the charging cage while the drill carriages D, D are moved backward with a predetermined length. Subsequently, as shown in FIG. (C), the blasting holes are charged with the dynamite so as to blast the upper portion in order to make a new facing in the upper portion. As shown in FIG. (D), the two drill carriages D, D are moved backward to a lower stage L. Next, the same operation as the operation explained in FIGS. (A), (B) and (C) are carried out again also for the lower portion. Then, the above mentioned operation is started again and repeated several times. Mortar shooting is carried out with a mortar shooting apparatus having one arm. An air duct W is provided in the tunnel and a mortar injection car A is used for the mortar shooting so as to fix the rock bolts.

In the prior art, there are problems as follows.

(1) the full face cutting method

This method can not be used when the natural ground is unstable.

(2) the long bench cut method

As explained before, this method includes the two ways. First, in the simultaneous driving for the upper and lower portions, operation can be progressed in the both portions simultaneously without interval. Thus, it has an advantage that construction period is reliable. However, in the lower portion, many operators and apparatuses are required. Since priority is given to the operation in the upper portion, the operation in the lower portion can not be carried out efficiently. Accordingly, the construction cost of this method is expensive. Further, due to the simultaneous driving in the both portions, heavy machines and cars may be scraped each other, the operators may fall from a slope and muck from cars may hit the operators. Moreover, the work environment of this method is low. For example, when the lower portion is blasted, the air duct may be damaged resulting in incomplete ventilation. Further, blasting, mucking, concrete shooting are performed many times in the upper portion. Thus, dust is often produced in such operation. It is understood from the above description that the simultaneous driving has many problems.

On the other hand, in the alternate driving for the upper and lower portions, new facing is always formed in one portion; the upper portion or the lower portion. Accordingly, as for workability, safety and work environment, this alternate driving has advantages. Further, since the same apparatuses and operators can be used in the both portions, it can be carried out efficiently. However, when the natural ground is not unstable, it can not be performed smoothly, thus, its construction period can not be reliable. Further, in this alternate driving, it takes long time to remove and reset the air duct, electrical wires and the like.

(3) the short bench cut method

When this method is carried out with the blasting treatment, apparatuses should be prevented from being damaged by blasting operation. Accordingly, a slope must be formed so that the apparatuses can go up and down between the upper and lower portions through this slope. On the other hand, when this method is carried out with the mechanical treatment, it is very difficult to perform invert closure in short time.

(4) the minibench cut method

With this method, simultaneous operation in the upper and lower portions can not be performed actually, which means low workability.

(5) the multistage bench cut method

In this method, multiple stages are provided. Accordingly, closure is often carried out lately resulting in large deformation of a tunnel. Further, operation often disturbs each other.

(6) the silot method

In this method, generally, operation and invert closure can not be carried out in the both upper and lower portions at the same time. Accordingly, this method requires longer construction term and high construction cost.

Next, in the conventional operation with drifters, two drill carriages are used. Thus, machinery cost is increased and the number of operators are doubled. Further, there is a fear of scraping of the drill carriages on the both sides.

On the other hand, recently, many tunnels have large cross sections. In this situation, several number of drill carriages should be used effectively. However, actually, it is difficult to use the several number of drill carriages.

SUMMARY OF THE INVENTION

It is object of the present invention to provide an efficient tunnel driving method, particularly for a tunnel having large cross section.

It is another object of the present invention to provide a tunnel driving method in which machinery cost and the number of operators can be decreased.

It is also another object of the present invention to provide a tunnel driving method in which workability can be progressed extremely.

In the first embodiment of the tunnel driving method according to the present invention, single drill carriage, which is provided with at least two charging cages and at least two drill booms having drifters, is used. The first embodiment of the tunnel driving method comprising repetitions of continuous stages [(A) to (D)] of;

(A) placing the drill carriage at the center of a tunnel and before a short bench located at the foot of a facing in order that
  (A1) the two charging cages are moved toward an upper portion so as to mark blasting holes and rock bolt holes for the upper portion and
  (A2) the at least two drill booms are operated so as to bore the blasting holes and the rock bolt holes for the upper portion;

(B) moving the drill carriage backward with a predetermined length in order that
  (B1) the two charging cages are moved so as to insert rock bolts into the rock bolt holes for the upper portion, while the at least two drill booms are operated so as to bore blasting holes and rock bolt holes for a lower portion located under the bench and
  (B2) the two charging cages are operated so as to insert rock bolts into the rock bolt holes for the lower portion and so as to charge the blasting holes for the upper portion and the blasting holes for the lower portion with dynamite;

(C) blasting the upper portion and the lower portion so that the facing is broken and a new facing of the upper portion and a new facing of the lower portion are formed; and (D) carrying out after-treatments including concrete shooting.

In the second embodiment of the tunnel driving method according to the present invention, at least two drill carriages are used. Each drill carriage is provided with at least two charging cages and at least two drill booms having drifters. The second embodiment of the tunnel driving method comprising repetitions of continuous stages [(A) to (D)] of;

(A) placing the drill carriages at the center of a tunnel and before a short bench located at the foot of a facing, under the condition that the drill carriages are operated for forward portions with respect to the drill carriages respectively, in order that
  (A1) the two charging cages are moved toward an upper portion so as to mark blasting holes and rock bolt holes for the upper portion and
  (A2) the at least two drill booms are operated so as to bore the blasting holes and the rock bolt holes for the upper portion;

(B) moving the two drill carriages backward with a predetermined length, under the condition that the drill carriages are operated for the forward portions with respect to the drill carriages respectively, in order that
  (B1) the two charging cages are moved so as to insert rock bolts into the rock bolt holes for the upper portion, while the at least two drill booms are operated so as to bore blasting holes and rock bolt holes for a lower portion located under the bench and
  (B2) the two charging cages are operated so as to insert rock bolts into the rock bolt holes for the lower portion and so as to charge the blasting holes for the upper portion and the blasting holes for the lower portion with dynamite;

(C) blasting the upper portion and the lower portion so that the facing is broken and a new facing of the upper portion and a new facing of the lower portion are formed, under the condition that the drill carriages are operated for the forward portions with respect to the drill carriages respectively; and (D) carrying out after-treatments including concrete shooting.

In the third embodiment of the tunnel driving method according to the present invention, at least two drill carriages are used. Each drill carriage is provided with at least two charging cages and at least two drill booms having drifters. The third embodiment of the tunnel driving method comprising parallel repetitions of two groups [(A) to (D) and (E) to (G)] of continuous stages of;

(A) placing the two drill carriages at the center of a tunnel and before a short bench located at the foot of a facing in order that
  (A1) the two charging cages are moved toward an upper portion so as to mark blasting holes and rock bolt holes for the upper portion and
  (A2) the at least two drill booms are operated so as to bore the blasting holes and the rock bolt holes for the upper portion;

(B) moving the two drill carriages backward with a predetermined length in order that
  (B1) the two charging cages are moved so as to insert rock bolts into the rock bolt holes for the upper portion, while the two drill booms are operated for a third enlargement other than lower side enlargements so as to bore blasting holes for the third enlargement and
  (B2) the two charging cages are operated so as to charge the blasting holes for the upper portion and the blasting holes for the third enlargement with dynamite;

(C) blasting the upper portion and the third enlargement so that the facing is broken and a new facing of the upper portion and a new facing of the third enlargement are formed; and (D) carrying out after-treatments including concrete shooting; and (E) placing another drill carriage or a machine provided with at least a charging cage and a drill boom before the lower side enlargements so as to bore blasting holes for the lower side enlargements and rock bolt holes on the side walls of the lower side enlargements, inserting rock bolts into the rock bolt holes and charging the blasting holes with dynamite, while the two charging cages are operated so as to charge the blasting holes for the upper portion and the blasting holes for the third enlargement with the dynamite [(B2)];

(F) moving the other drill carriage or the machine away from the lower side enlargements so as to blast the lower side enlargements, when the upper portion and the third enlargement are blasted so that the facing is broken and the new facing of the upper portion and the new facing of the third enlargement are formed [(C)]; and (G) carrying out after-treatments including concrete shooting.

In the fourth embodiment of the tunnel driving method according to the present invention, at least two drill carriages are used. Each drill carriage is provided with at least two charging cages and at least two drill booms having drifters. The fourth embodiment of the tunnel driving method comprising parallel repetitions of two groups [(A) to (D) and (E)] of continuous stages of;

(A) placing the two drill carriages at the center of a tunnel and before a short bench located at the foot of a facing in order that (A1) the two charging cages are moved toward an upper portion so as to mark blasting holes and rock bolt holes for the upper portion and (A2) the at least two drill booms are operated so as to bore the blasting holes and the rock bolt holes for the upper portion;

(B) moving the two drill carriages backward with a predetermined length in order that (B1) the two charging cages are moved so as to insert rock bolts into the rock bolt holes for the upper portion, while the two drill booms are operated for a third enlargement other than lower side enlargements so as to bore blasting holes for the third enlargement and (B2) the two charging cages are operated so as to charge the blasting holes for the upper portion and the blasting holes for the third enlargement with dynamite;

(C) blasting the upper portion and the third enlargement so that the facing is broken and a new facing of the upper portion and a new facing of the third enlargement are formed; and (D) carrying out after-treatments including concrete shooting; and (E) placing another drill carriage or a machine provided with at least a charging cage and a drill boom before the lower side enlargements so as to bore blasting holes for the lower side enlargements and rock bolt holes on the side walls of the lower side enlargements, inserting rock bolts into the rock bolt holes, charging the blasting holes with dynamite, moving the other drill carriage or the machine away from the lower side enlargements so as to blast the lower side enlargements and carrying out after-treatments including concrete shooting, when concrete shooting is started in the upper portion and the third enlargements [(D)] after blasting the upper portion and the third enlargement so that the facing is broken and the new facing of the upper portion and the new facing of the lower portion are formed [(C)].

In the fifth embodiment of the tunnel driving method according to the present invention, at least two drill carriages are used. Each drill carriage is provided with at least two charging cages and at least two drill booms having drifters. The fifth embodiment of the tunnel driving method comprising parallel repetitions of two groups [(A) to (D) and (E)] of continuous stages of;

(A) placing the two drill carriages at the center of a tunnel and before a short bench located at the foot of a facing in order that (A1) the two charging cages are moved toward an upper portion so as to mark blasting holes and rock bolt holes for the upper portion and (A2) the at least two drill booms are operated so as to bore the blasting holes and the rock bolt holes for the upper portion;

(B) moving the two drill carriages backward with a predetermined length in order that (B1) the two charging cages are moved so as to insert rock bolts into the rock bolt holes for the upper portion, while the two drill booms are operated for a third enlargement other than lower side enlargements so as to bore blasting holes for the third enlargement and (B2) the two charging cages are operated so as to charge the blasting holes for the upper portion and the blasting holes for the third enlargement with dynamite;

(C) blasting the upper portion and the third enlargement so that the facing is broken and a new facing of the upper portion and a new facing of the third enlargement are formed; and (D) carrying out after-treatments including concrete shooting; and (E) placing the two drill carriages before the lower side enlargements so as to bore blasting holes of lower side enlargements and rock bolt holes of the side walls of the lower side enlargements, inserting rock bolts into the rock bolt holes, charging the blasting holes with dynamite, moving the two drill carriages away from the lower side enlargements so as to bore blasting holes for the lower side enlargements and rock bolt holes on the side walls of the lower side enlargements, inserting rock bolts into the rock bolts holes, charging the blasting holes with dynamite, moving the other drill carriage or the machine away from the lower side enlargements so as to blast the lower side enlargements and carrying out after-treatments including concrete shooting, when concrete shooting is started in the upper portion and the third enlargements [(D)] after blasting the upper portion and the third enlargement so that the facing is broken and the new facing of the upper portion and the new facing of the lower portion are formed [(C)].

For unstable natural ground, the bench cut methods are used. Particularly, in the present invention, the short bench cut methods can be used suitably. The bench has the length of normally from 2 to 7 m, more normally from 3 to 4 m. Accordingly, when the drill carriage is placed before the bench (or the third enlargement), the charging cages and the drill booms can reach the upper portion. Then, in the present invention, since each drill carriage is provided with at least two charging cages and at least two drill booms, operation can be performed simultaneously in the upper portion and the lower portion or the upper portion and the third enlargement. Therefore, high workability is ensured. Further, in the present invention, since blasting is carried out simultaneously, construction time can be decreased.

On the other hand, when the cross section is large, according to the above mentioned second to fifth embodiments of the present invention, the plural number of drill carriages are placed before the facing so as to be substantially arranged in parallel with respect to the axis of the tunnel. As for the simultaneous driving method for the upper and lower portions in the conventional long bench cut methods, as explained before, there are many problems. However, in these embodiments according to the present invention, the tunnel driving can be carried out efficiently without the above mentioned problems due to the arrangement of the drill carriages.

Moreover, in each embodiment of the present invention, the drill carriage is provided with at least two charging cages and at least two, preferably three drill booms having drifters. It is sure that cost of one drill carriage of the present invention is higher to some degree than that of the conventional drill carriage. However, in order to attain the same workability, machine cost of the drill carriages of the present invention is extremely lower than that of the conventional drill carriages and the number of operators required in the drill carriage of the present invention is about 50% of that required in the conventional drill carriage. Particularly, since each drill carriage is provided with two charging cages, simultaneous operation in a wide area can be performed. Further, the drill carriage has two, more preferably three drill booms. Accordingly, while the rock bolt holes are bored with one drill boom, the blasting holes provided on the both sides with respect to the axis of the drill carriage are bored with another drill boom, more preferably other two drill booms. Therefore, it is understood that workability can be progressed also by the composition of the drill carriage.

In the present invention, during blasting, the drill carriages must go away. However, when the blasting is not carried out, each drill carriage always stays one place. Thus, accidents such as scraping with other heavy machine and other cars can be prevented. Further, the blasting is carried out in the upper portion and in the third enlargement or in the upper portion, the third enlargement and the low side enlargements simultaneously. Accordingly, dust exposure time can be shorten and ventilation can be performed more smoothly. That is to say, good working environment in the tunnel is ensured. On the other hand, in the prior art, each drill carriage should move between two places in the tunnel. Accordingly, tunnel equipments such as air ducts, electrical wires, iron pipes and the like were often damaged due to this movement of each drill carriage. Further, the tunnel equipments must be removed and reset every movement of each drill carriage. It produces large waste and loss. However, in the present invention, since each drill carriage almost stays one place in the tunnel, there is no fear of such waste and loss.

On the other hand, in the present invention, for a tunnel having large cross section, such as larger than 100 $m^2$, particularly larger than 140 $m^2$, the tunnel driving is carried out as follows.

The inner section of the tunnel is divided into work areas; the upper portion, the third enlargement and the lower side enlargements. Then, in the upper portion and the third enlargements, the operation is carried out with the two drill carriages substantially arranged so as to be parallel. Then, in the lower side enlargements, operation is carried out with the other drill carriage or a machine provided with at least the drill boom and the charging cage. However, in the prior art, for the tunnel having large cross section, the inner section of the tunnel is divided into just an upper portion and a lower portion. When the method related to the present invention is compared with this conventional method, it is understood that the method of the present invention can be applied for even unstable natural ground more efficiently. Because, after mucking for the third enlargement, the lower side enlargements are still remained. Accordingly, stable driving can be performed without disintegration. Moreover, the operation in the lower side enlargements is carried out so as to follow the operation in the upper portion and the third enlargement. Accordingly, operation is not interfered each other and high workability can be ensured.

Further objects and advantages of the present invention will be apparent from the following description, reference being had to the accompanying drawing wherein preferred embodiments of the present invention are clearly shown.

DESCRIPTION OF THE PREFERRED EMBODIMENT

Figure 1:
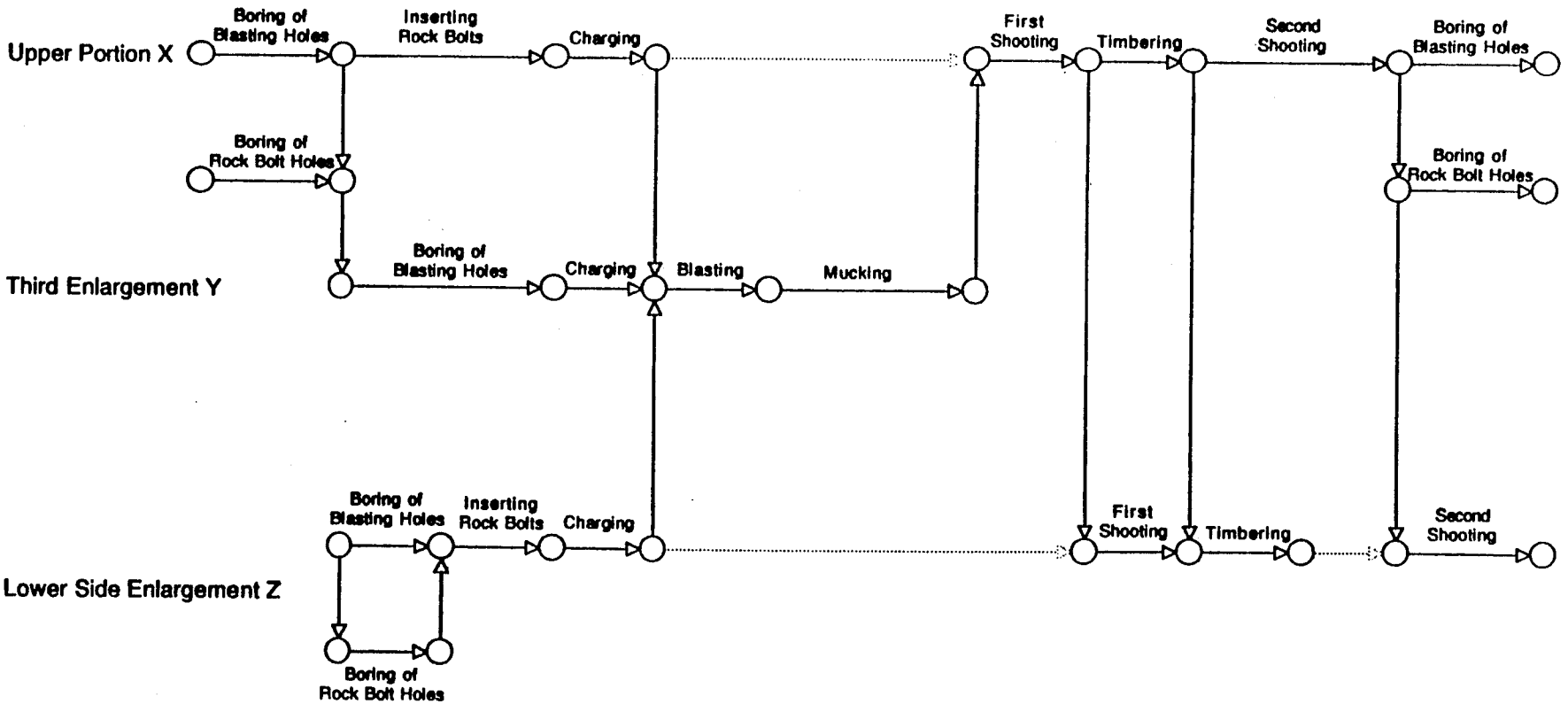
FIG. 1 is a flow sheet showing the tunnel driving method of the third embodiment.

Now, referring to the drawings, the present invention is described more particularly with embodiments.

Figure 4:
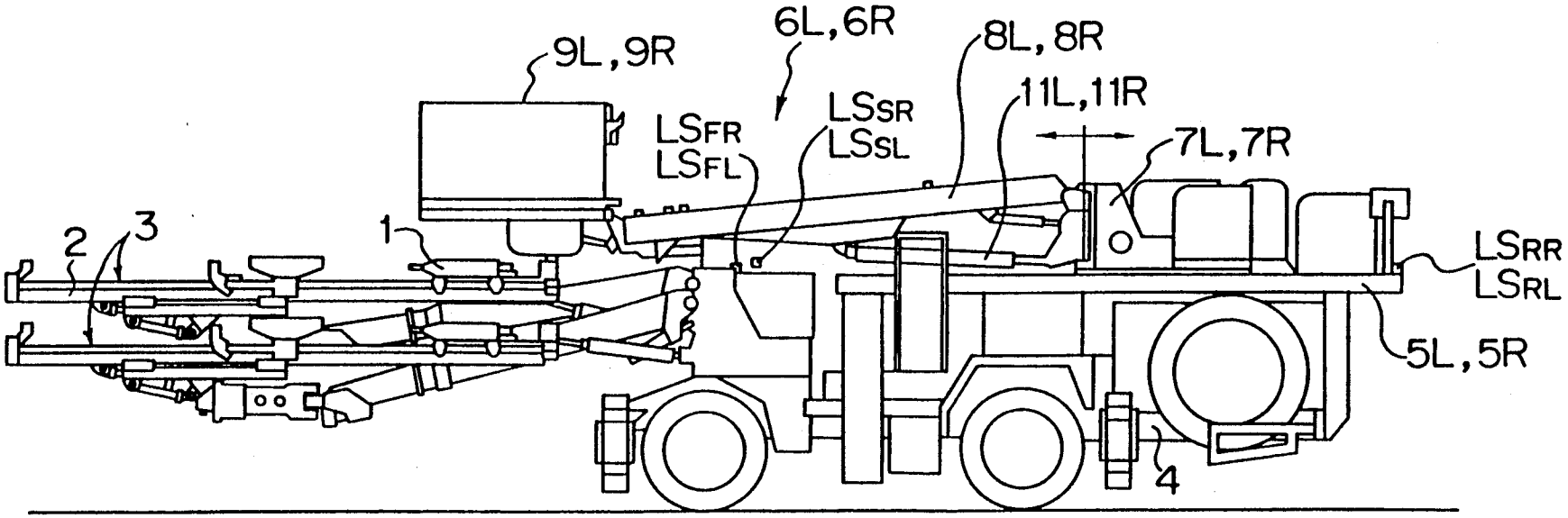
FIG. 4 is a front view of a drill carriage.
Figure 5:
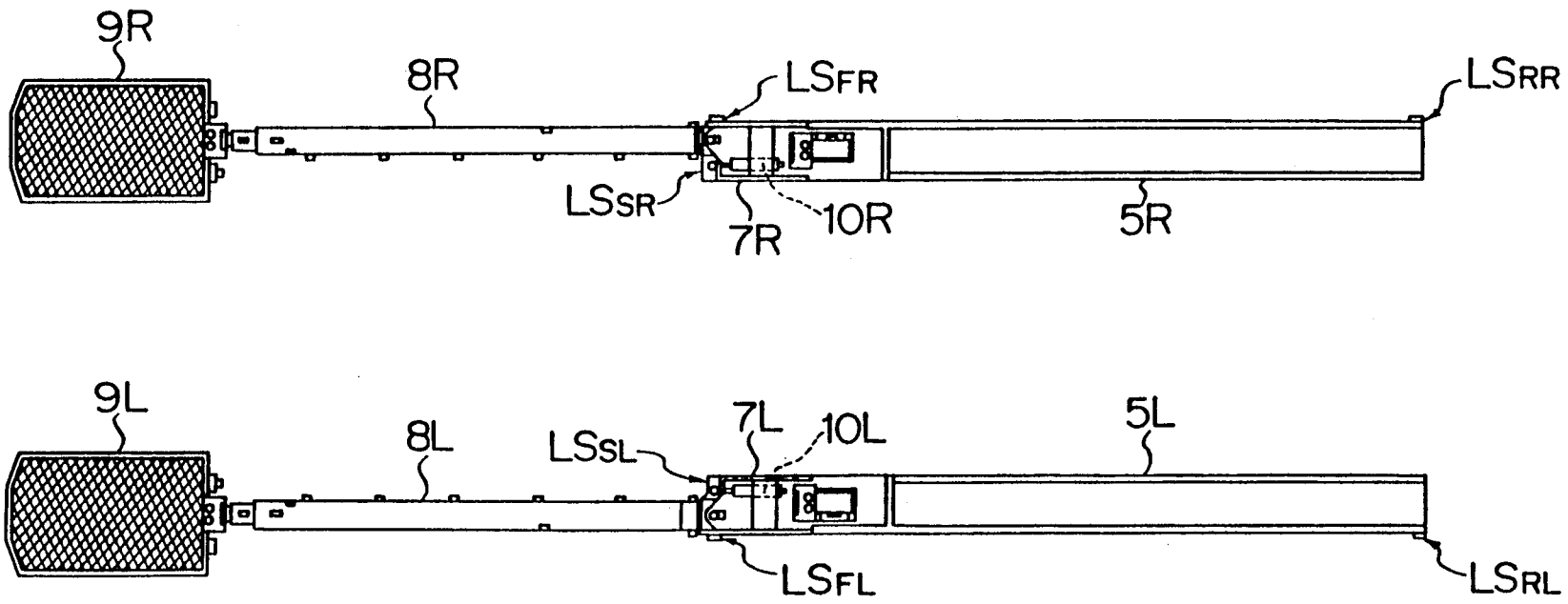
FIG. 5 is a plan view of the right and left charging cages of a drill carriage.
Figure 11:
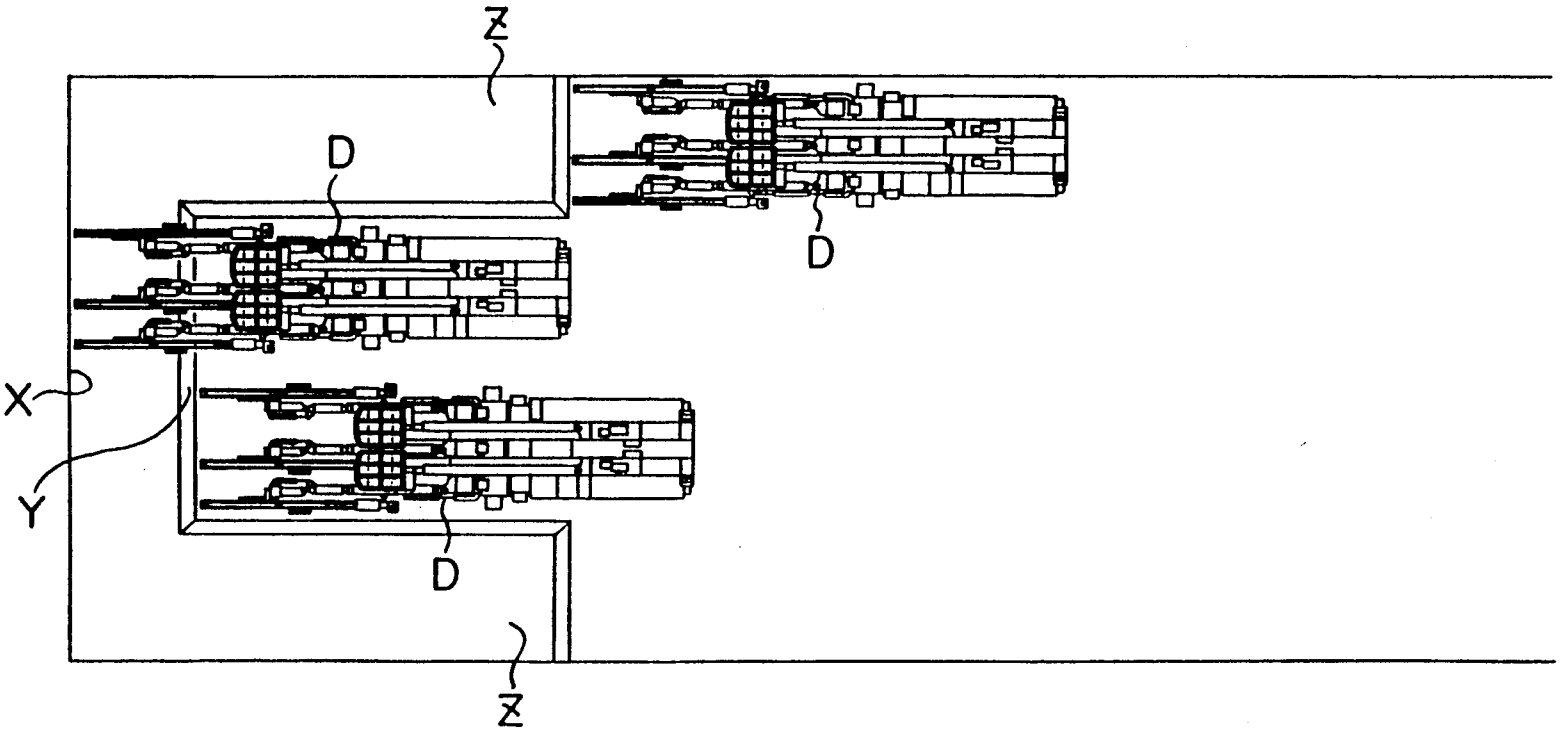
FIG. 11 is a top view showing operation for an upper portion, a third enlargement, lower side enlargements.
Figure 12:
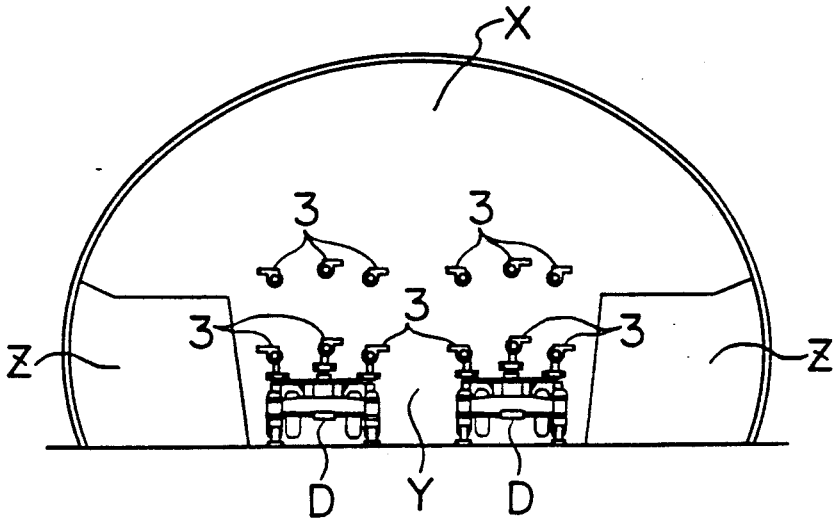
FIG. 12 is a front view showing the arrangement of drill carriages, of which drill booms can be moved vertically.

First, the examples of apparatuses used in the embodiments will be explained. FIGS. 4 and 5 show a drill carriage D according to the present invention. Although in FIG. 4, only two drill booms 3, 3 are visible. However, as shown in FIGS. 11 and 12, the drill carriage is provided with three drill booms. One drill boom is placed at its center and two drill booms are placed at its both sides.

In the drill carriage D, the above mentioned three drill booms 3, 3, 3 are provided in the front portion of a cart 4. Each guide shell 2 is supported by each drill boom 3. Each drifter 1 is equipped on each guide shell 2. Slide rails 5L, 5R are laid on the left and right sides of the cart 4. Then, two charging cages 6L, 6R are set on the slide rails 5L, 5R respectively so as to slide on the extending direction of the rails 5L, 5R. The charging cages 6L 6R comprise slide yokes 7L,7R, charging booms 8L, 8R and cage sections 9L, 9R, respectively. The slide yokes 7L,7R can be slid on the slide rails 5L, 5R, respectively. The bottom ends of the charging booms 8L, 8R are pivoted by the slide yokes 7L,7R respectively so as to direct upward and rotate. The cage sections 9L, 9R are pivoted by the other ends of the charging booms 8L, 8R, respectively. The charging booms 8L, 8R are rotated by rotation cylinders 10L, 10R, respectively. On the other hand, the charging booms 8L, 8R are directed by direction cylinders 11L, 11R, respectively.

Position limit switches $LS_{FL}$, $LS_{FR}$, $LS_{RL}$, $LS_{RR}$ are provided on the cart 4 in order to detect positions of the charging cages 6L, 6R. When the charging cages 6L, 6R are moved forward so as to locate at their operating positions, the position limit switches $LS_{FL}$, $LS_{FR}$ can detect it. On the other hand, when the charging cages 6L, 6R are moved backward so as to locate at their containing positions, the position limit switches $LS_{RL}$, $LS_{RR}$ can detect it. Angle limit switches $LS_{SL}$, $LS_{SR}$ are provided on the slide yokes 7L, 7R, in order to detect the limit angles of rotation of the charging booms 8L, 8R respectively.

With the tunnel driving method having composition described above, during drilling operation, the drill carriages are placed adjacent to a facing. Drilling is carried out by the drifters which are equipped on the guide shells supported by the drill booms, while the two charging cages go backward so as to locate on the containing positions respectively. After the drilling, the charging cages are moved forward so as to locate on the operating positions for charging with explosive. The position limit switches can detect whether the two charging cages locate at the operating positions or the containing positions. Under such location, the charging booms 8L, 8R begin to rotate inward so as to approach each other. The angle limit switches can detect their angles. Electromagnetic directional control valves are provided on the hydraulic actuation circuit of the rotation cylinder. These valves are controlled by signal from the position and angle limit switches so that the charging booms rotate just with predetermined limit angles. That is to say, the charging booms are prevented from being interfered with each other due to the control of their rotation angle.

For operation with one charging cage, this charging cage should locate at the operating position. On the other hand, another charging cage should locate at the containing position. The limit switches can detect their positions. In this case, even if the charging boom at the operating position rotates inward over the predetermined limit angle, the electromagnetic directional control valves are not controlled so that the charging boom can rotate with a full stroke given by the rotation cylinder. In this situation, since the other charging cage locates at the containing position, there is no interference.

THE FIRST EMBODIMENT

Figure 6:
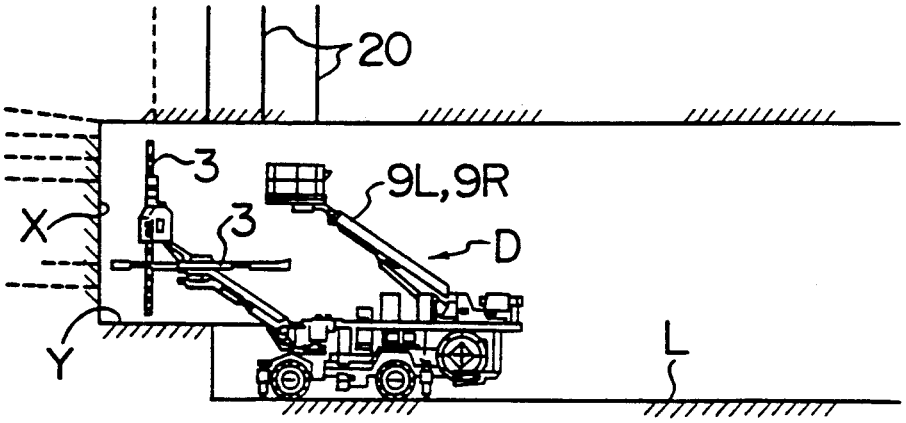
FIG. 6 is a side view showing operation in the upper portion.

In the first embodiment, single drill carriage D provided with at least two charging cages and at least two drill booms having drifters is used:

(A) First, as shown in FIG. 6, the above mentioned drill carriage D is placed at the center of the tunnel and before a short bench Y located at the foot of a facing. In this situation, (A2) the at least two drill booms are operated so as to bore the blasting holes and the rock bolt holes for the upper portion;

(A2) Then, the charging cages 9L, 9R are moved backward once. Subsequently, at least two, preferably three drill booms 3, 3, 3 are operated so as to bore the blasting holes and the rock bolt holes for the upper portion. In this case, while the rock bolt holes are bored with one drill boom, the blasting holes are bored with the other drill booms. Accordingly, the drill booms are operated simultaneously to give high efficiency for the drilling.

Figure 7:
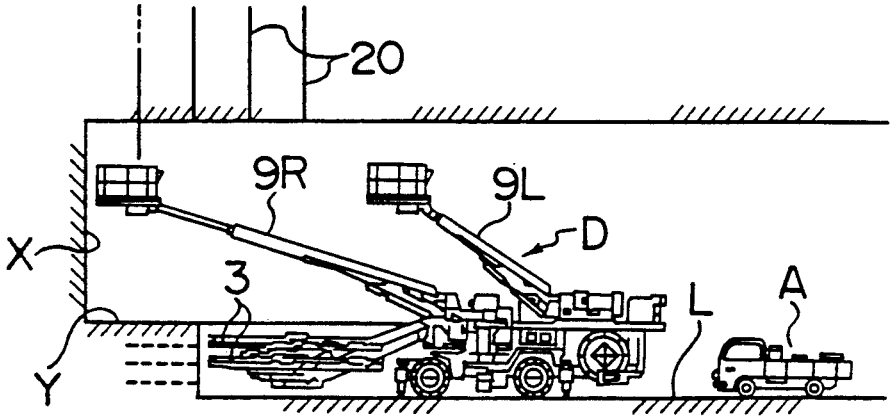
FIG. 7 is a side view showing operation next to the operation of FIG. 6 before the third enlargement.

(B) Next, as shown in FIG. 7, the drill carriage D is moved backward with a predetermined length, for example, 3–4 m. In this situation, (B1) the two charging cages 9L, 9R are moved so as to insert the rock bolts into the rock bolt holes of the upper portion. At the same time, the at least two, preferably three drill booms 3, 3, 3 are operated so as to bore the blasting holes and the rock bolt holes for a lower portion under the bench Y.

Figure 8:
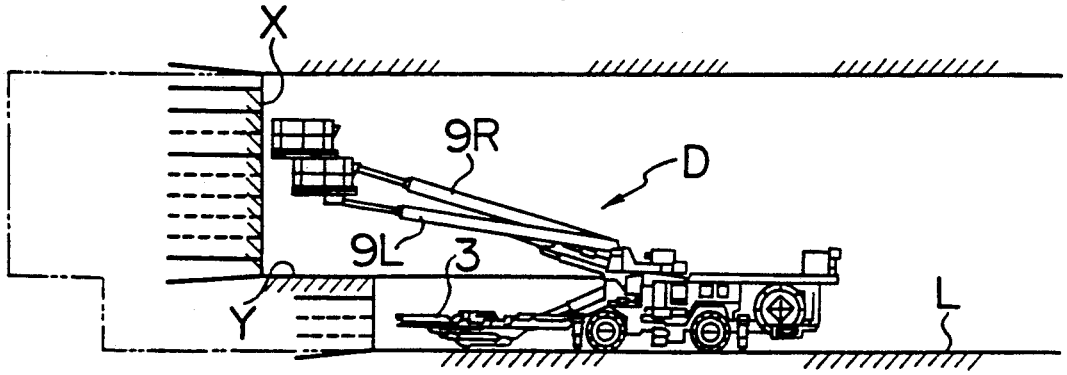
FIG. 8 is a side view showing operation next to the operation of FIG. 7 before the third enlargement.

(B2) Then, as shown in FIG. 8, the two charging cages 9L, 9R are operated so as to insert rock bolts into the rock bolt holes for the lower portion. At the same time, the blasting holes of the upper portion and the blasting holes of the lower portion are charged with dynamite.

(C) Subsequently, the upper portion and the lower portion are blasted simultaneously so that the facing is broken and a new facing of the upper portion and a new facing of the lower portion are formed. After this blasting, mucking is carried out. This mucking will be stated in other explanation of other embodiments.

(D) Finally, after-treatments such as concrete shooting are carried out.

Thus, operation of stages (A) to (D) is repeated.

THE SECOND EMBODIMENT

The second embodiment differs from the first embodiment in that, instead of the single drill carriage D of the first embodiment, two drill carriages D, D are placed so as to be parallel with respect to the axis of a tunnel. As for this embodiment, the example is not shown in figures. Because, operation of the second embodiment with the two drill carriages D, D is the same as operation of the first embodiment with the single drill carriage D except that operation is carried for forward portions with respect to the drill carriages D, D arranged in parallel respectively.

Figure 3:
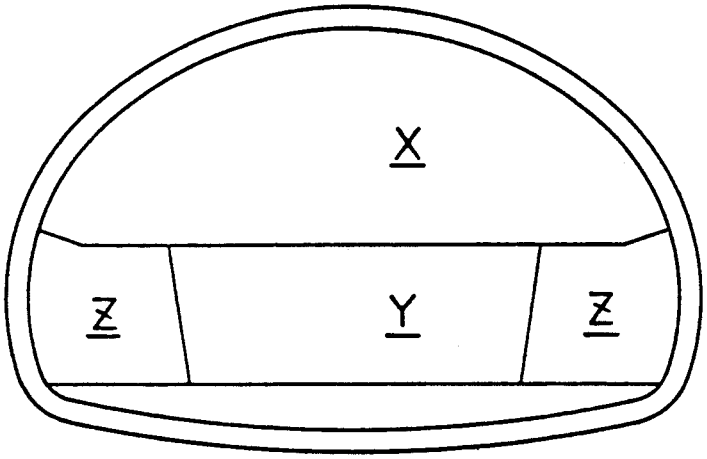
FIG. 3 is a cross section of a tunnel related to the present invention.

In the embodiments including the third embodiment stated hereinafter, the tunnels mainly have large cross sections. Accordingly, as shown in FIG. 3, the cross section of each tunnel is divided into an upper portion X, a third enlargement Y, lower side enlargements Z, Z.

THE THIRD EMBODIMENT

FIG. 1 is a flow sheet showing the third embodiment of the tunnel driving method with three drill carriages according to the order of stages.

Figure 9:
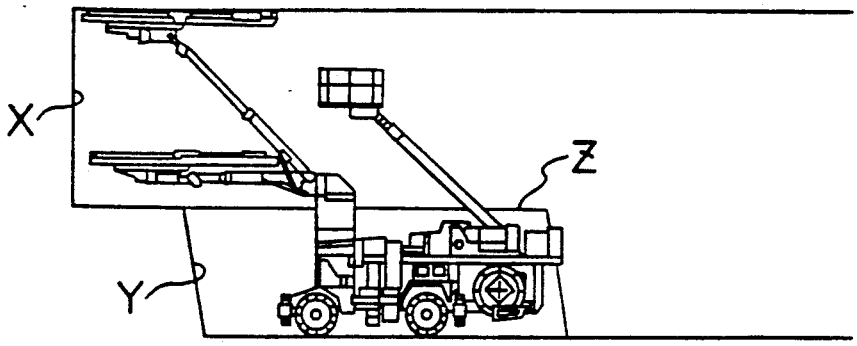
FIG. 9 is a side view showing operation for an upper portion with a drill carriage, of which drill boom can be moved vertically.

As shown in FIGS. 6 to 11, at least two, preferably three drill carriages are used (See FIG. 11) in this third embodiment. Then, each drill carriage is provided with at least two charging cages and at least two, preferably three drill booms having drifters:

(A) First, as shown in FIGS. 6 and 9 (but in these figures, only one drill carriage is shown), the two drill carriages are placed at the center of the tunnel and before a bench (the third enlargement Y), which is short of 3–4 m and which is located at the foot of the facing. In this situation, (A1) the two charging cages 9L, 9R are moved toward the upper portion so as to mark blasting holes and rock bolt holes for the upper portion X. At the same time, lifter holes and sub-lifter holes can be formed in the upper portion X.

(A2) Then, the charging cages 9L, 9R are moved backward once. Subsequently, at least two, preferably three drill booms 3, 3, 3 are operated so as to bore the blasting holes and the rock bolt holes for the upper portion. In this case, while the rock bolt holes are bored with one drill boom, the blasting holes are bored with the other drill booms. Accordingly, the drill booms are operated simultaneously to give high efficiency for the drilling.

Figure 10:
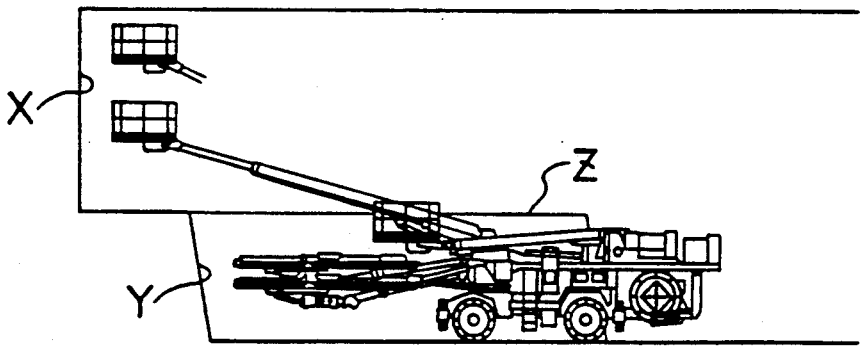
FIG. 10 is a side view showing operation before a third enlargement with drill carriages, of which drill booms can be moved vertically.

(B) Next, as shown in FIGS. 7, 8 and 10, the drill carriages D, D are moved backward with a predetermined length, for example, 3–4 m. In this situation, (B1) the two charging cages 9L, 9R are moved so as to insert rock bolts into the rock bolt holes for the upper portion X. At the same time, the suitable number of, for example, three drill booms 3, 3, 3 are operated for a third enlargement Y other than the lower side enlargements Z, Z so as to bore the blasting holes of the third enlargement Y. However, the rock bolts can be inserted into the rock bolt holes at the back and center of the upper portion X in the stage (A2). That is to say, right after boring and before the drill carriage D is moved backward, the charging cages are moved for inserting the rock bolts. An mortar injection car A (See FIG. 7) is used for fixing the rock bolts.

(B2) Then, the two charging cages 9L, 9R are operated so as to charge the blasting holes for the upper portion X and the blasting holes for the third enlargement Y with dynamite.

Figure 14:
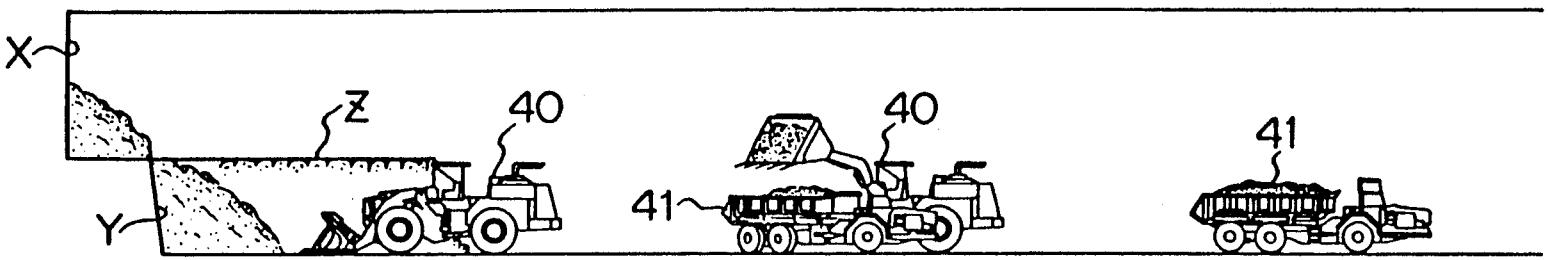
FIG. 14 is a side view showing mucking.
Figure 15:
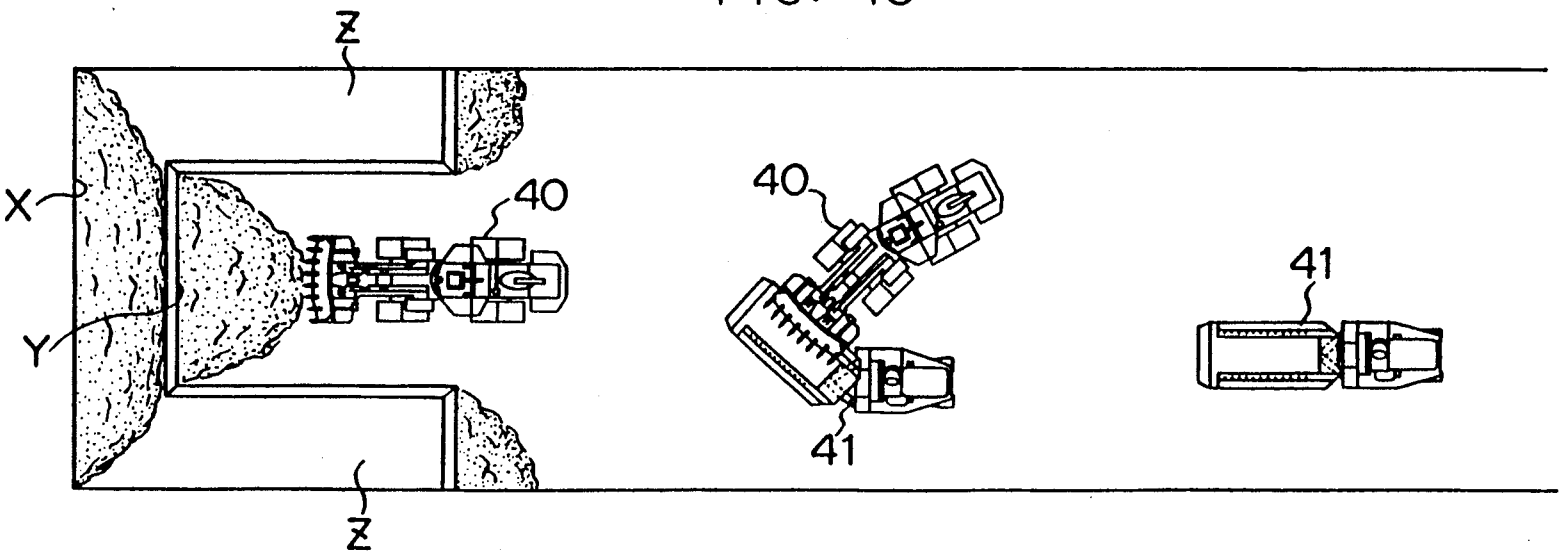
FIG. 15 is a top view showing mucking.

(C) Subsequently, as shown in FIGS. 14 and 15, the upper portion X and the third enlargement Y are blasted so that the facing is broken and a new facing of the upper portion and a new facing of the third enlargement are formed. After blasting, mucking is carried out. Numerical 40 and numerical 41 indicate a wheel roller and a dump truck respectively.

Figure 16:
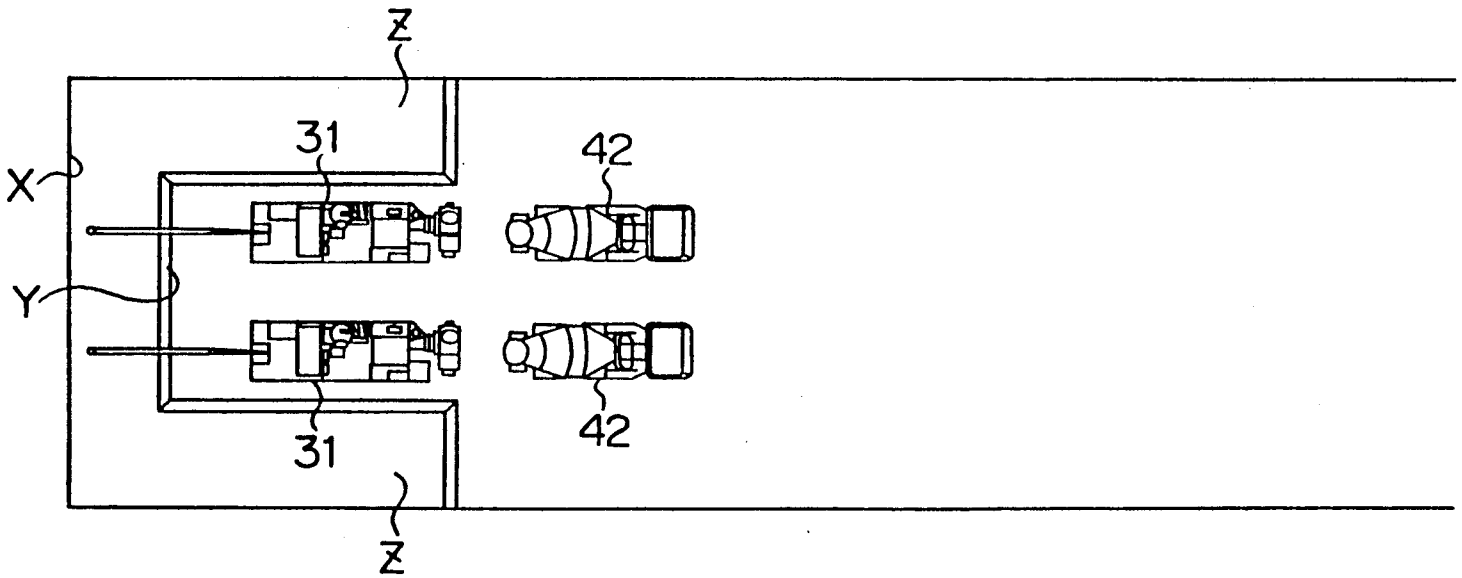
FIG. 16 is a top view showing shooting.
Figure 17:
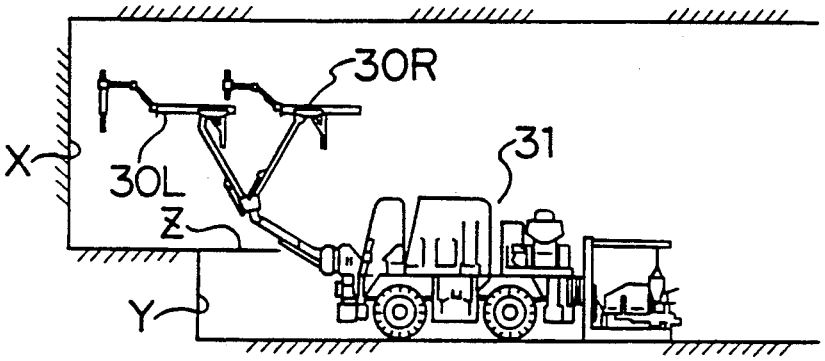
FIG. 17 is a side view showing shooting.
Figure 18:
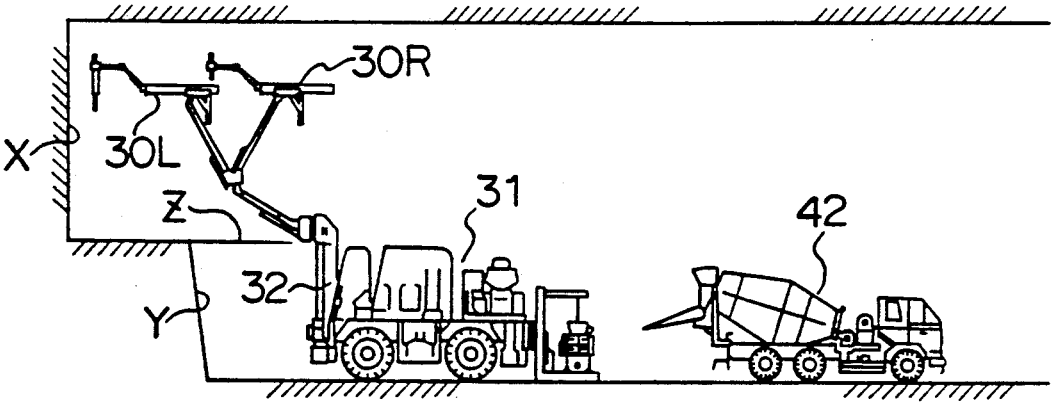
FIG. 18 is a side view showing shooting with a shooting car, of which shooting arm can be moved vertically.

(D) With shooting cars 31, 31, as shown in FIGS. 16 to 18, the first and second operation of concrete shooting is carried out. Numerical 42 indicates a truck for carrying concrete to be shot. After shooting, operation of stages (A) to (D) is carried out according to its order with the two drill carriages D, D.

(E) On the other hand, during operation in the stage (B2), following operation is carried out. As shown in FIG. 11, another drill carriage D' is placed before one lower side enlargement Z. In this situation, blasting holes for the lower side enlargement Z and the rock bolt holes on the side walls of the lower side enlargement Z are bored. Then, rock bolts are inserted into the rock bolt holes and the blasting holes are charged with dynamite. After this continuos operation is finished in the lower side enlargement Z, the other drill carriage D is moved to another lower side enlargement Z so that this continuous operation is performed there.

(F) When blasting of stage (C) is carried out, the other drill carriage D is moved away from the lower side enlargement Z for blasting in the lower side enlargement Z.

(G) Then, concrete is shot for the lower side enlargement Z.

After shooting, operation of stages (E) to (G) is carried out according to its order with the other drill carriage D'.

In this case, as shown in FIGS. 1 and 15, mucking of the upper portion X, that of the third enlargement Y and that of the lower side enlargements Z, Z are performed simultaneously. Then, the first operation of concrete shooting for the upper portion X is carried out.

Next, the first operation of concrete shooting for the lower side enlargements Z, Z is carried out, while timbering is constructed in the upper portion X. Subsequently, the second operation of concrete shooting for the upper portion X is carried out, while timbering is constructed against the both side walls of the lower side enlargements Z, Z. Next, the second operation of concrete shooting for the lower side enlargements Z, Z is carried out. On the other hand, when the above mentioned second operation of concrete shooting for the upper portion X is finished, the two drill carriages D, D are moved forward to locate before the facing of the third enlargement Y so that the operation explained above for a next facing is carried out repeatedly.

Figure 19:
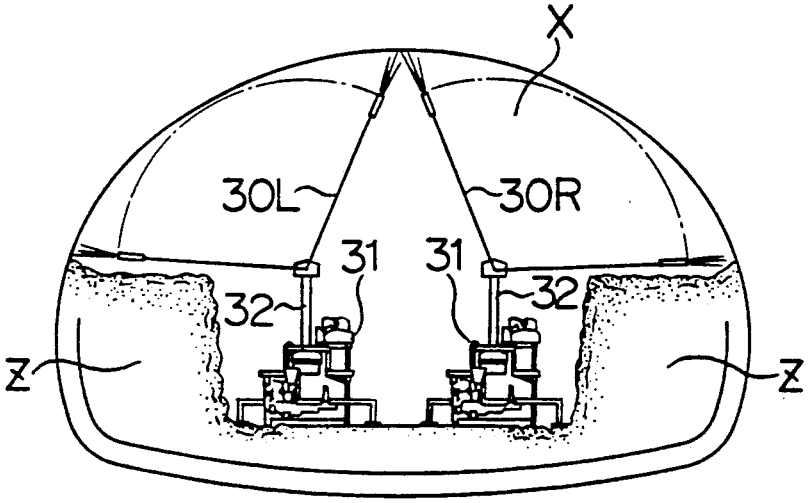
FIG. 19 is a front view showing shooting with shooting cars, of which shooting arms can be moved vertically.

One shooting car having one shooting arm can be used in order to shoot concrete against the whole cross section. However, as shown in FIG. 17, a shooting car 31 having two shooting arms 30L, 30R can be used in a preferable embodiment. More preferably, since the cross section of the tunnel is large, as shown in FIGS. 16, 18 and 19, two shooting cars 31, 31 are used. Each shooting car 31 is provided with shooting arms 30L, 30R with its attaching head 32 which can move vertically. For right-side and left-side portions of the tunnel, shooting can be performed simultaneously with these shooting cars resulting in high workability.

In this tunnel driving method of the third embodiment, the operation in the lower side enlargements Z, Z is carried out with the other drill carriage D'. However, this operation can be performed with another machine having at least a drill boom and a charging cage.

THE FOURTH EMBODIMENT

Figure 2:
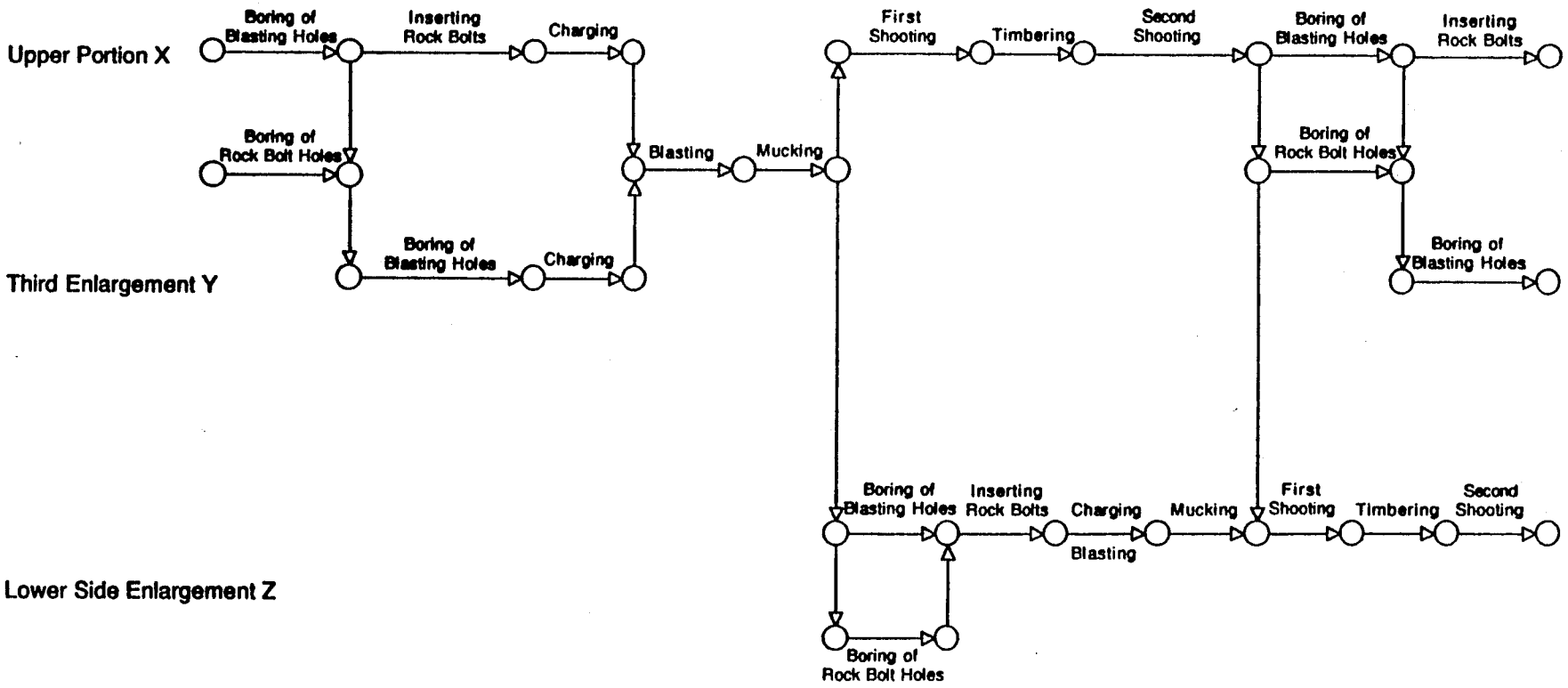
FIG. 2 is a flow sheet showing the tunnel driving method of the fourth embodiment related to the present invention.
Figure 20:
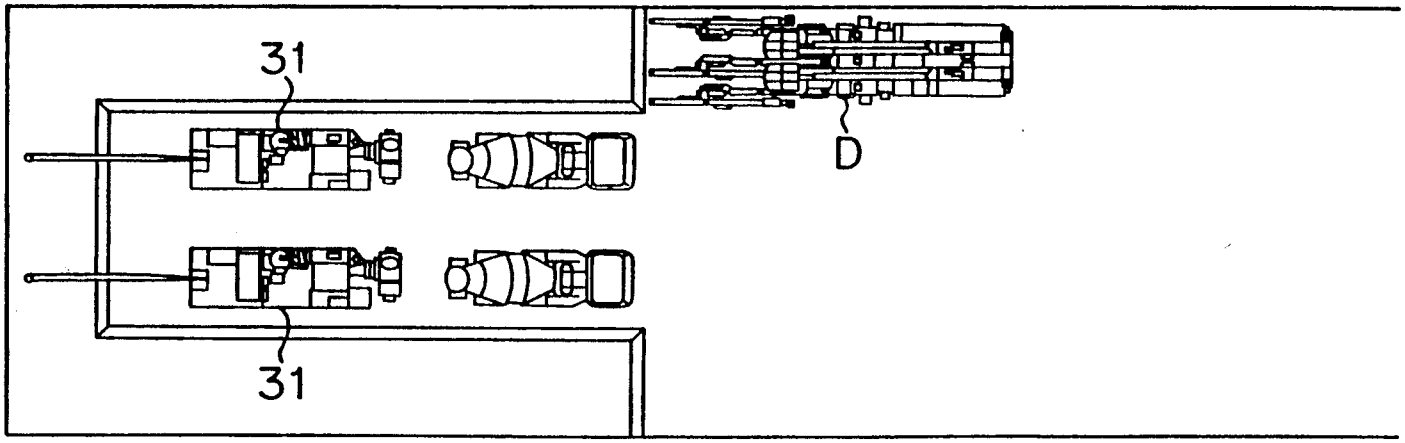
FIG. 20 is a top view showing shooting and operation for lower side enlargements carried out simultaneously with only two drill carriages.
Figure 21:
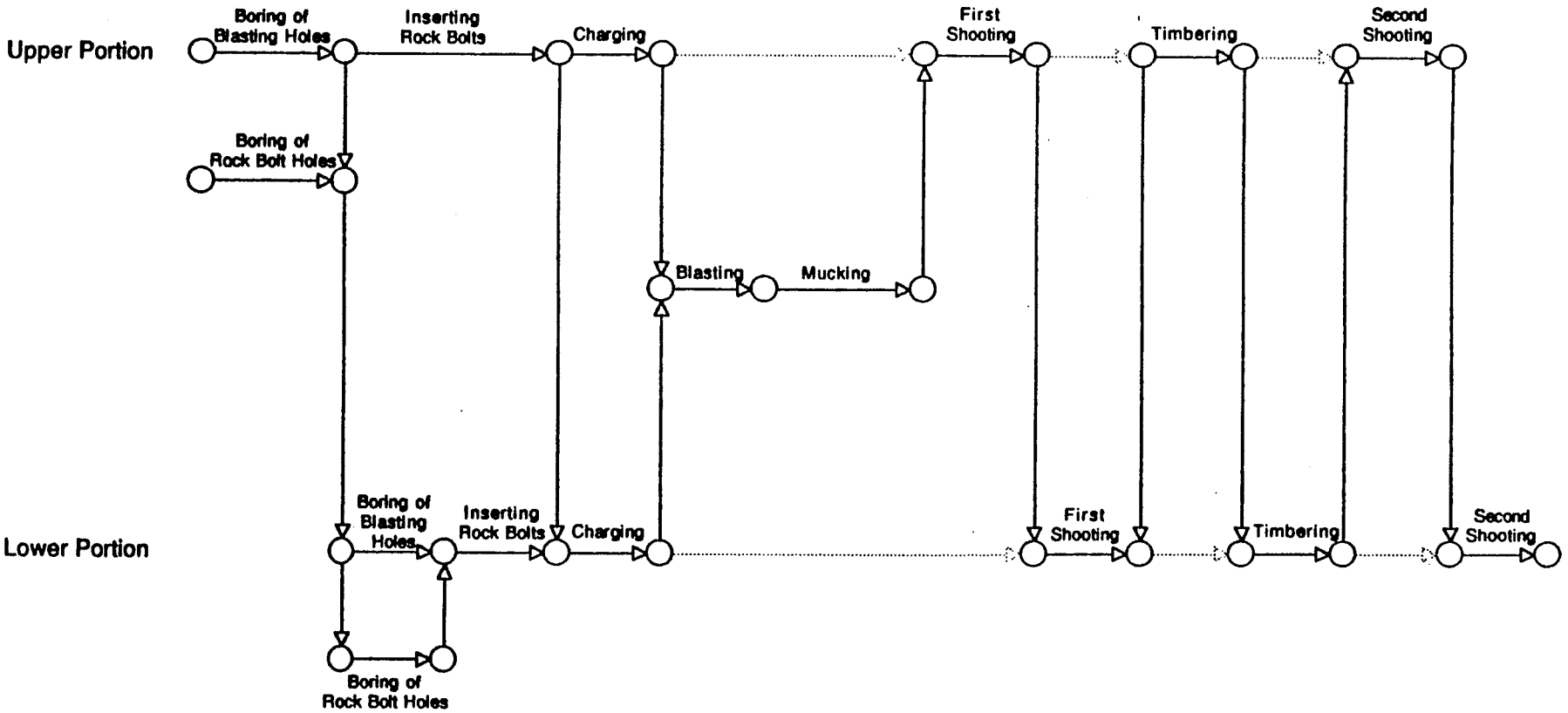
FIG. 21 is a flow sheet showing the driving method of the modified second embodiment related to the present invention.

In the fourth embodiment, tunnel driving method with only two drill carriages is described. The same operation as the operation in the stages (A) and (B) of the third embodiment, and the same blasting as the blasting in the stage (C) also of the third embodiment, are carried out for the upper portion X and the third enlargement Y. Then, after mucking, as shown in FIGS. 2 and 20, the shooting cars 31, 31 are located before the new third enlargement Y for concrete shooting for the upper portion X and the new third enlargement Y. During concrete shooting, the drill carriages D, D are moved forward so as to locate before the lower side enlargements Z, Z so as to bore blasting holes of the lower side enlargements Z, Z and rock bolt holes of the side walls of the lower side enlargements Z, Z. Then, the rock bolts are inserted into the rock bolt holes and the blasting holes are charged with dynamite. Subsequently, the drill carriages D, D are moved away from the lower side enlargements Z, Z so as to blast the lower side enlargements Z, Z and mucking is performed. After concrete shooting for the upper portion X and the third enlargement Y, the shooting cars 31, 31 are moved to locate in the lower side enlargements Z, Z so as to shoot concrete against the side walls of the lower side enlargements Z, Z and timbering is constructed there. When concrete shooting is finished, the operation explained above is carried out for a next facing repeatedly.

For tunnel driving performed according to the flow sheet of FIG. 2, the operation for the lower side enlargements Z, Z can be carried out with another machine instead of the other drill carriage D'. This machine is provided with at least a drill boom and a charging cage.

Figure 13:
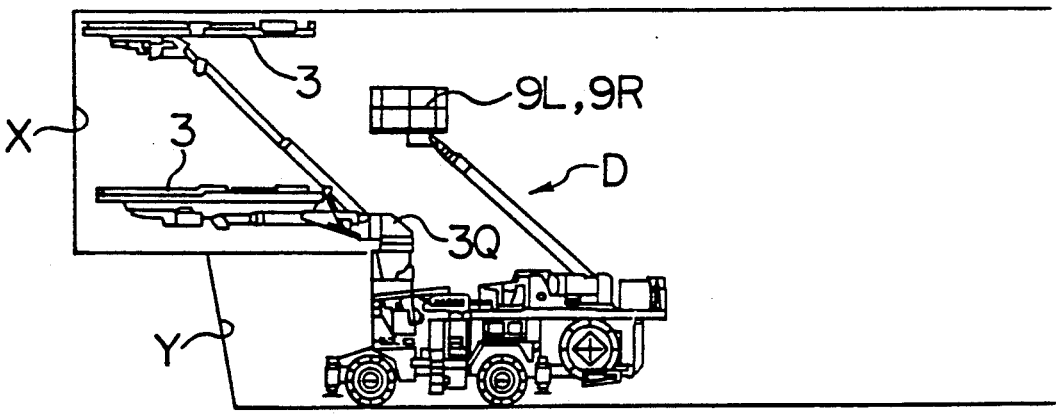
FIG. 13 is a side view showing the arrangement of drill carriages, of which drill booms can be moved vertically.

When the cross section of the tunnel is large, it is needless to say that operational areas in the upper portion X and the third enlargement Y are also large. Thus, as shown in FIGS. 10, 12 and 13, an attaching mount 3Q of the three drill booms 3, 3, 3 having drifters is preferably provided on each drill carriage D so as to move vertically. If desired, in this method, larger number of drill carriages, charging cages and drill booms can be used.

A MODIFIED SECOND EMBODIMENT

Figure 22:
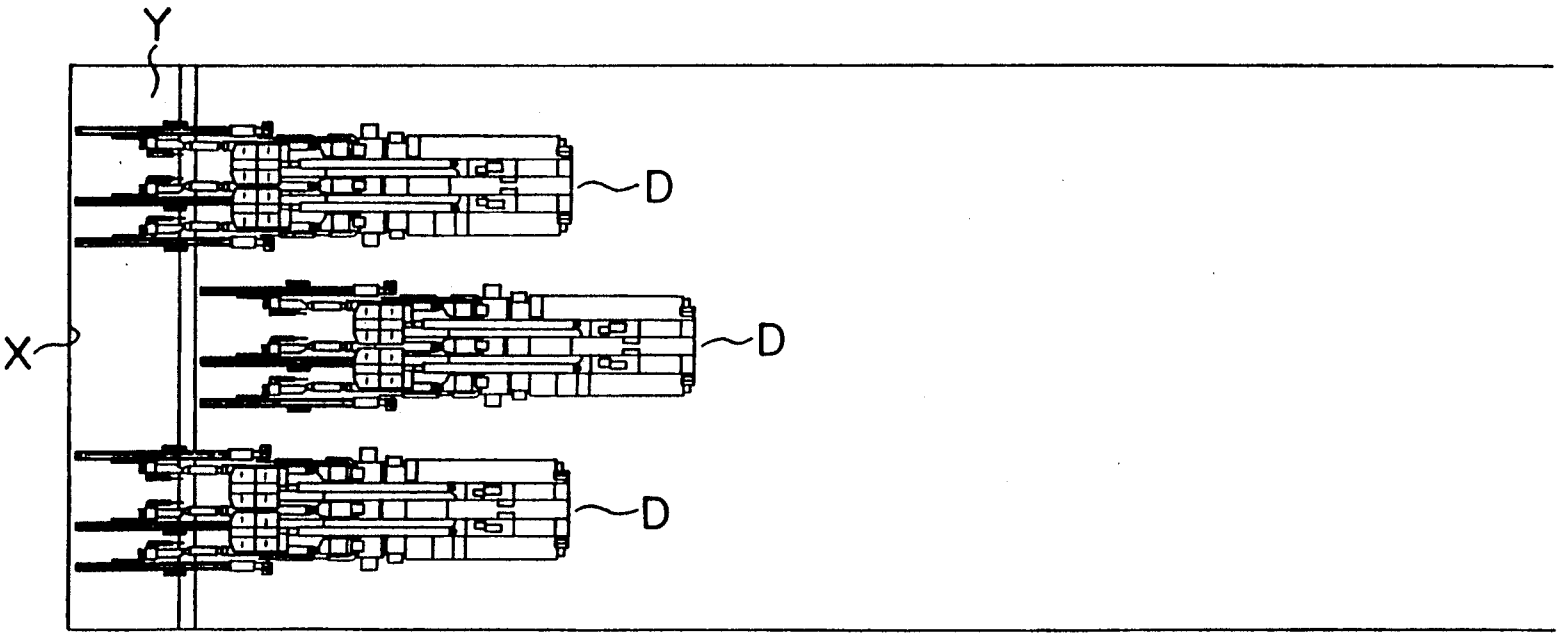
FIG. 22 is a top view showing driving situation with three drill carriages.
Figure 23:
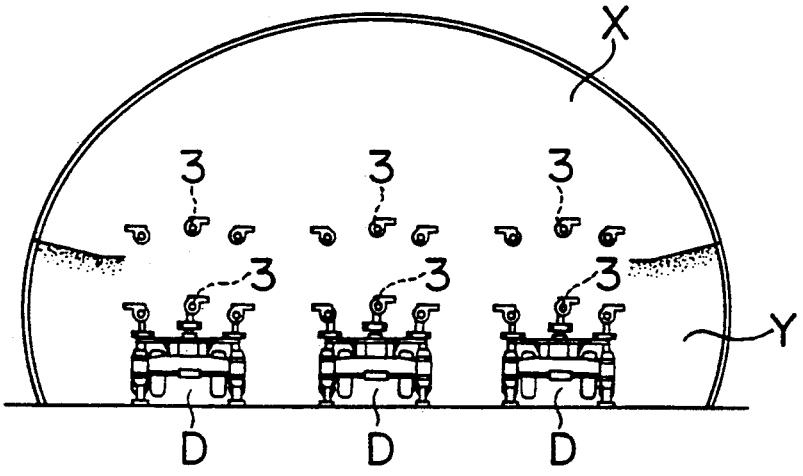
FIG. 23 is a front view showing the arrangement of the three drill carriages.

The modified second embodiment is shown in FIGS. 21 to 25. In this embodiment, three drill carriages D, D, D are used. Then, each drill carriage D is provided with at least two charging cages and at least two drill booms having drifters:

(A) First, as shown in FIGS. 22 and 23, the three drill carriages D, D, D are placed so as to be parallel before a short bench located at the foot of the facing. In this situation,
  - (A1) the charging cages are moved toward an upper portion so as to mark blasting holes and rock bolt holes for the upper portion.
  - (A2) Then, the at least two drill booms are operated so as to bore the blasting holes and the rock bolt holes for the upper portion.

(B) Next, the three drill carriages D, D, D are moved backward with a predetermined length. In this situation,
  - (B1) the charging cages are moved so as to insert rock bolts for the upper portion. At the same time, the above mentioned drill booms are operated for a lower portion located under the bench so as to bore blasting holes and rock bolt holes for the lower portion.
  - (B2) Then, the charging cages are operated so as to insert rock bolts into the rock bolt holes for the lower portion, while the blasting holes for the upper portion and the blasting holes for the lower portion are charged with dynamite.

(C) Subsequently, the upper portion and the lower portion are blasted so that the facing is broken and a new facing of the upper portion and a new facing of the lower portion are formed.

Figure 24:
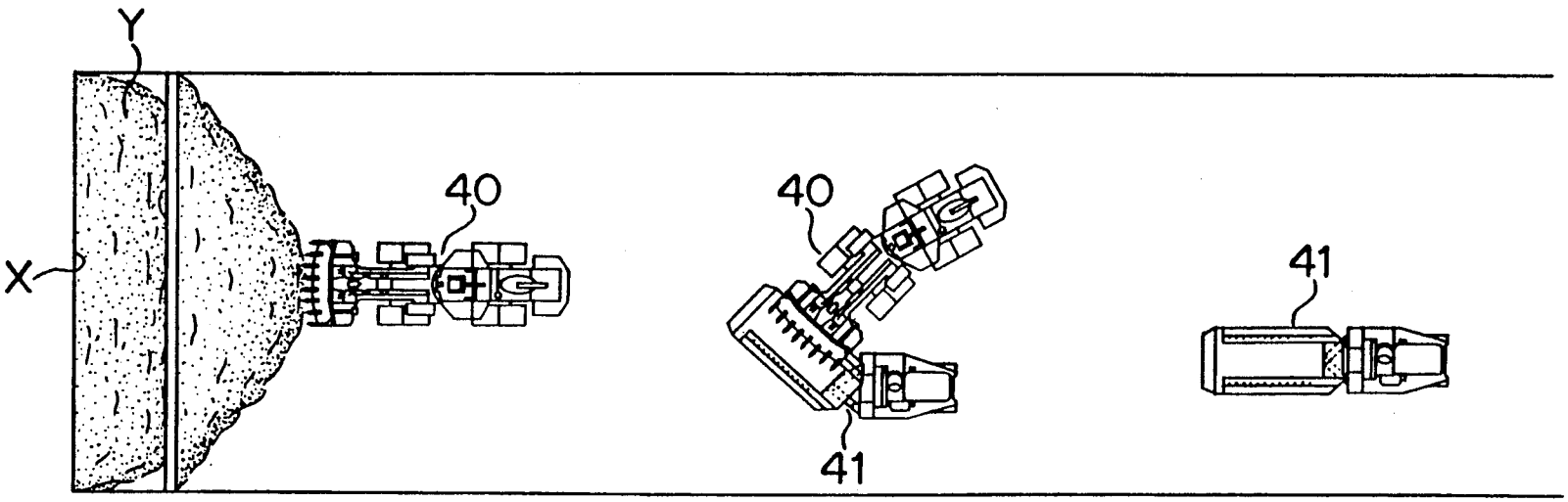
FIG. 24 is a top view showing mucking.
Figure 25:
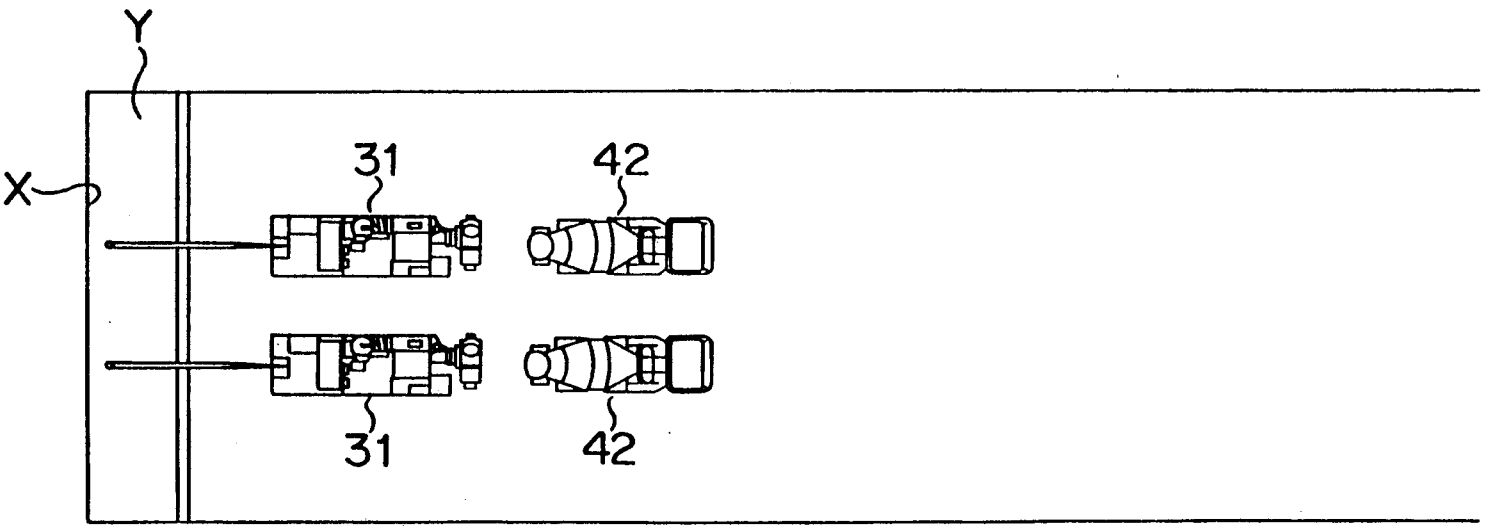
FIG. 25 is a top view showing shooting.

(D) Then, as shown in FIG. 24, mucking is carried out. Finally, after-treatments such as concrete shooting are carried out in the upper portion and the lower portion alternately.

Thus, operation of stages (A) to (D) is repeated.

On the other hand, operation instages (A) to (C) is carried out, under the condition that the drill carriages are operated for forward portions with respect to the drill carriages respectively.

OTHER EMBODIMENTS

Figure 26:
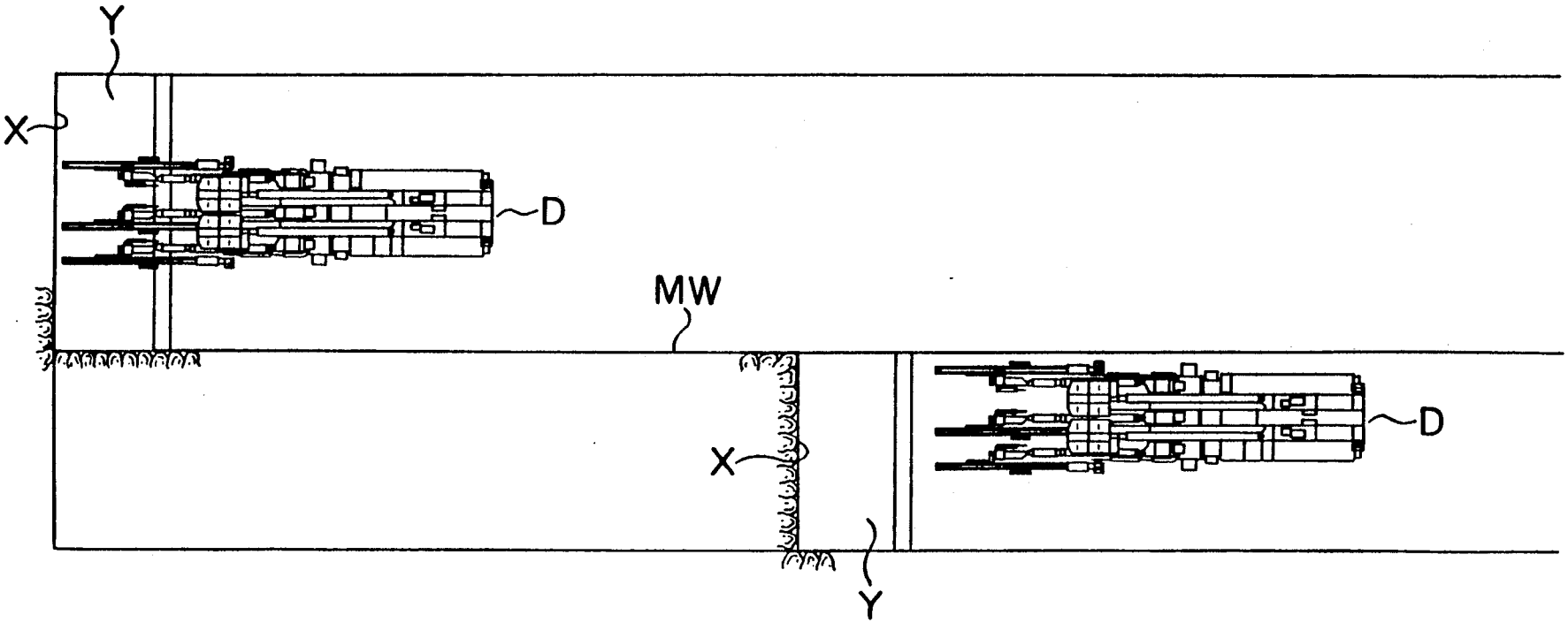
FIG. 26 is a top view showing driving situation where a middle wall is provided.
Figure 27:
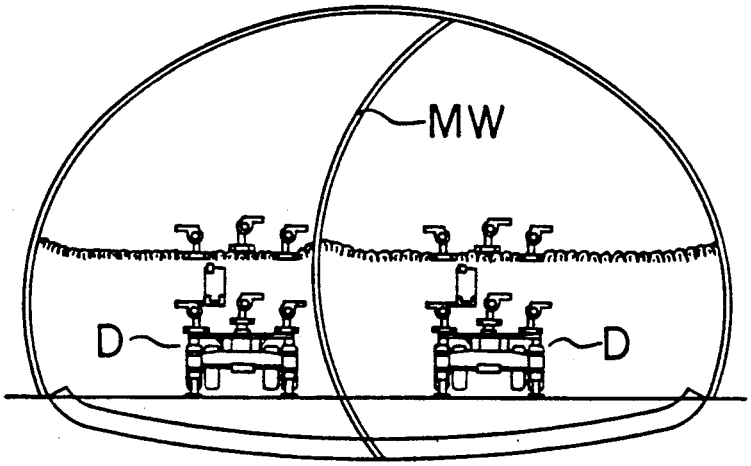
FIG. 27 is a front view of FIG. 26.
Figure 28:
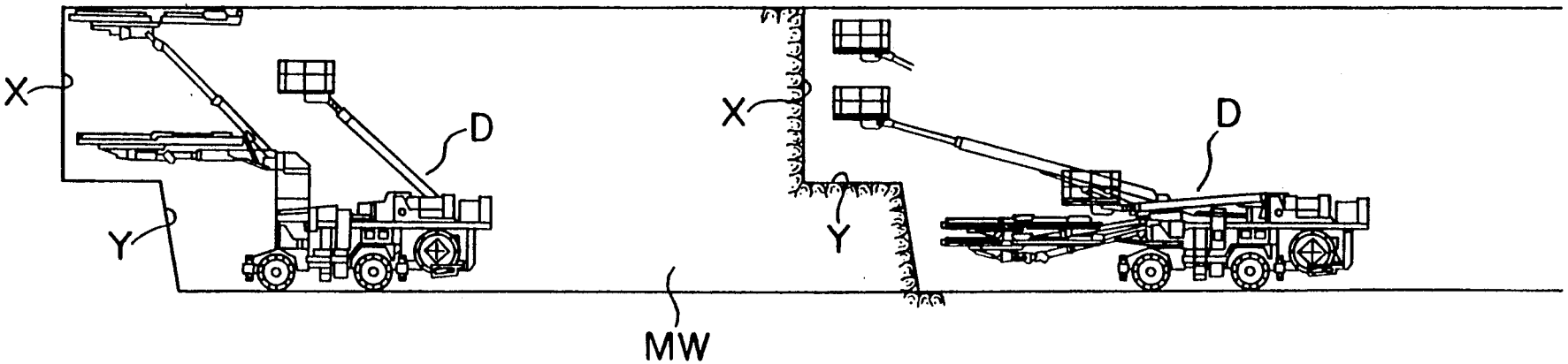
FIG. 28 is a side view of FIG. 26.
Figure 29:
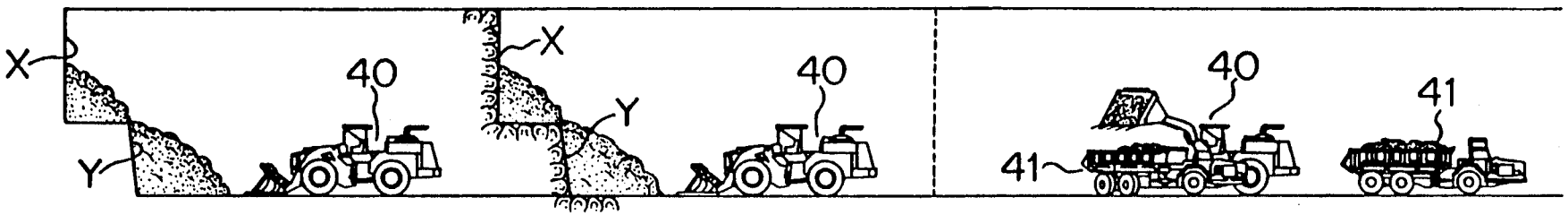
FIG. 29 is a side view showing mucking where a middle wall is provided.
Figure 30:
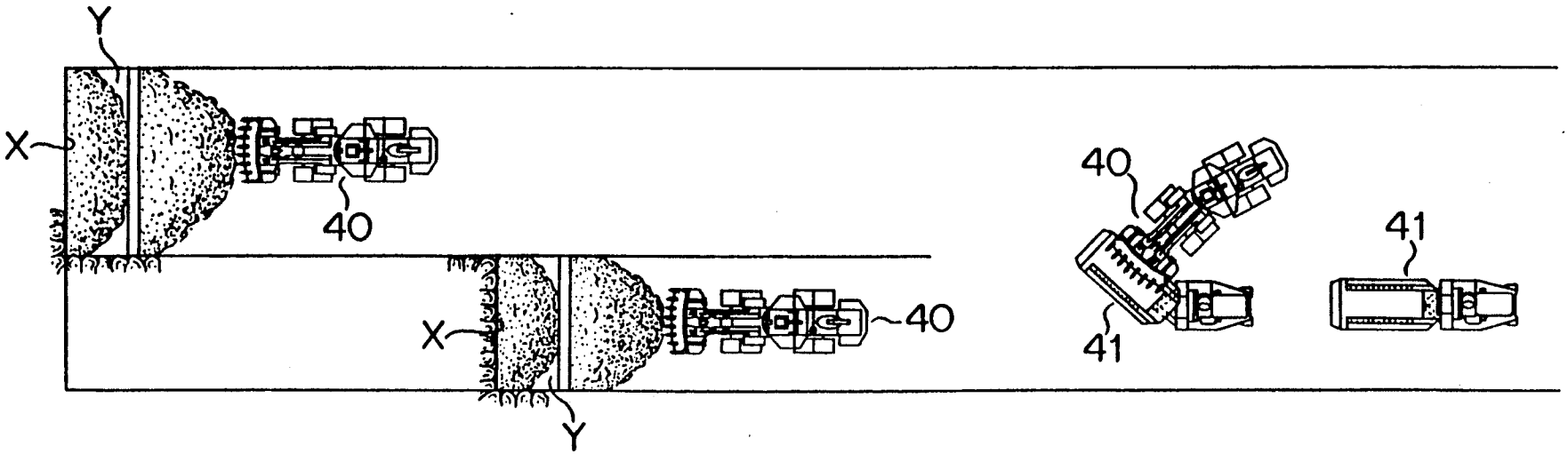
FIG. 30 is a top view of FIG. 29.
Figure 31:
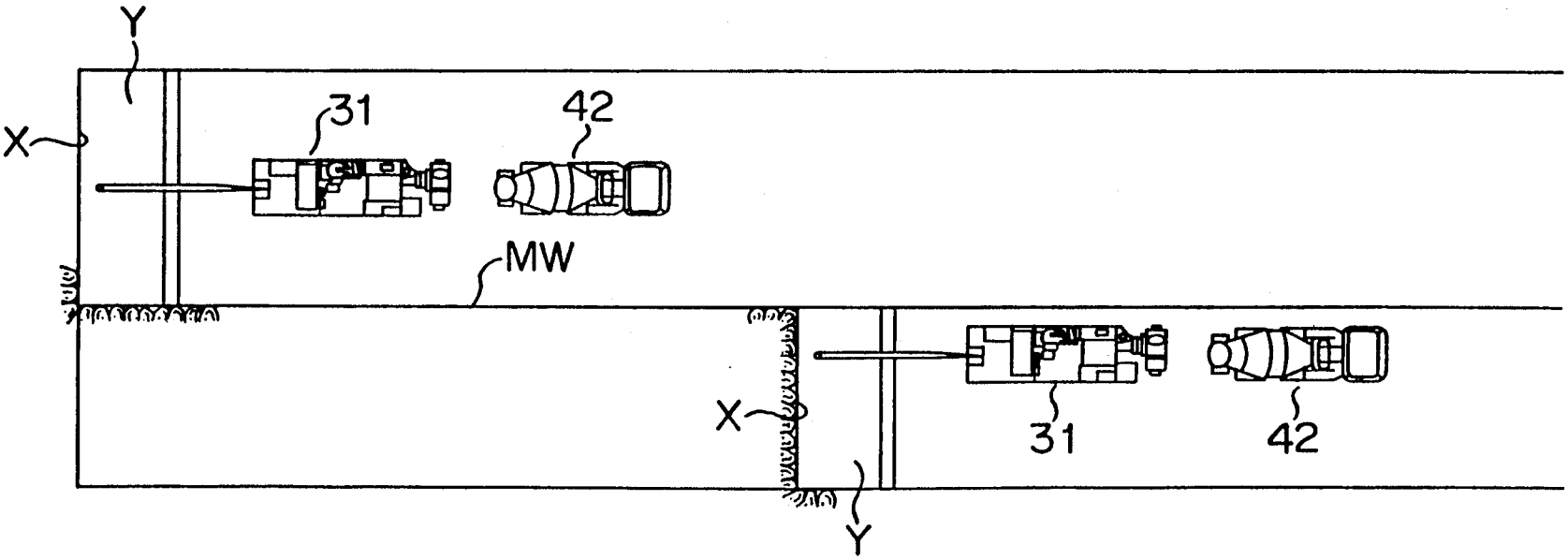
FIG. 31 is a top view showing shooting where a middle wall is provided.
Figure 32:
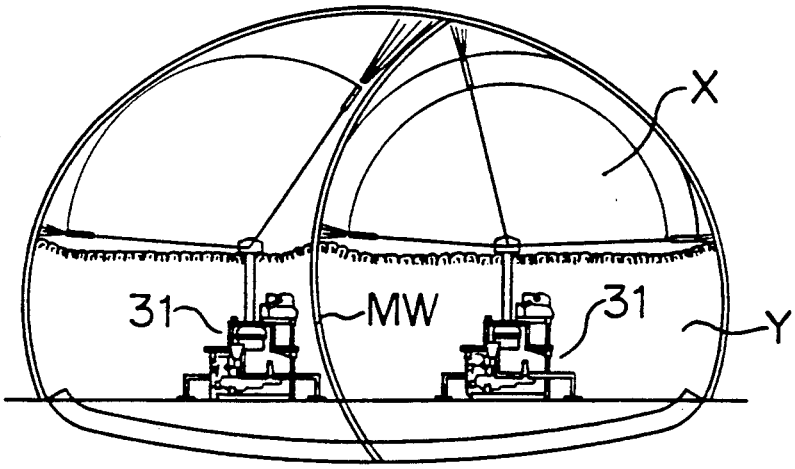
FIG. 32 is a front view of FIG. 31.
Figure 33:
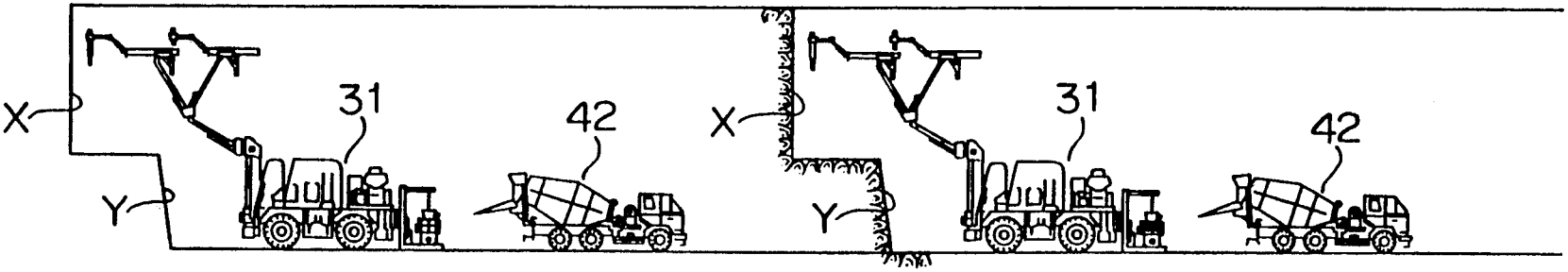
FIG. 33 is a side view of FIG. 31.

Another embodiment in case that the cross section of the tunnel is further larger or the natural ground is unstable is shown in FIGS. 26 to 33. In this embodiment, while a middle wall is formed, operation in the above mentioned embodiments can be carried out. As shown in FIGS. 26 to 28, blasting holes and rock bolt holes are bored and rock bolts are inserted into the rock bolt holes. Mucking is shown in FIGS. 29 and 30. Shooting is shown in FIGS. 31 to 33.

Figure 34:
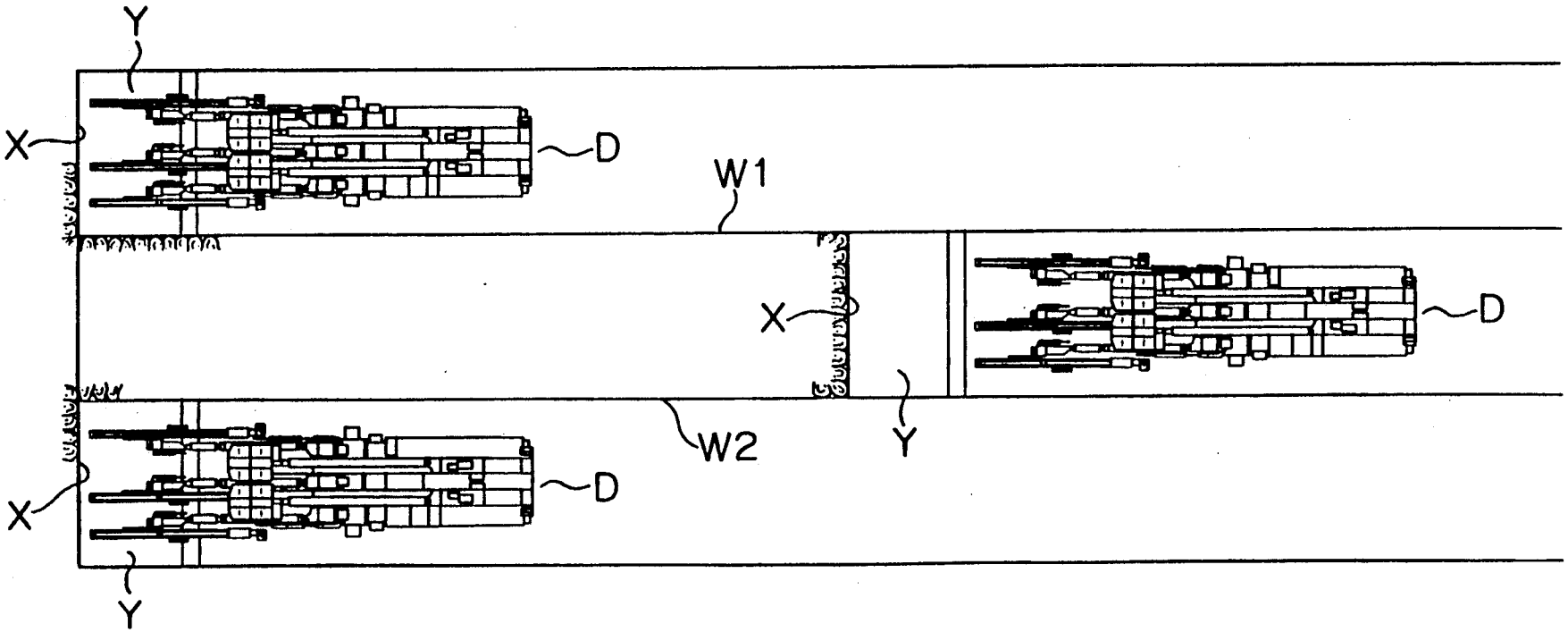
FIG. 34 is a top view showing boring and inserting bolts using a silot method according to the present invention.
Figure 35:
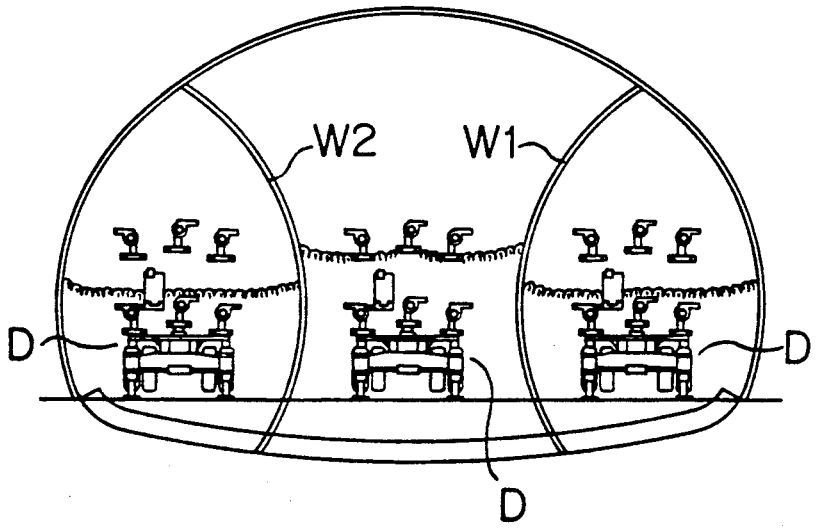
FIG. 35 is a front view of FIG. 34.
Figure 36:
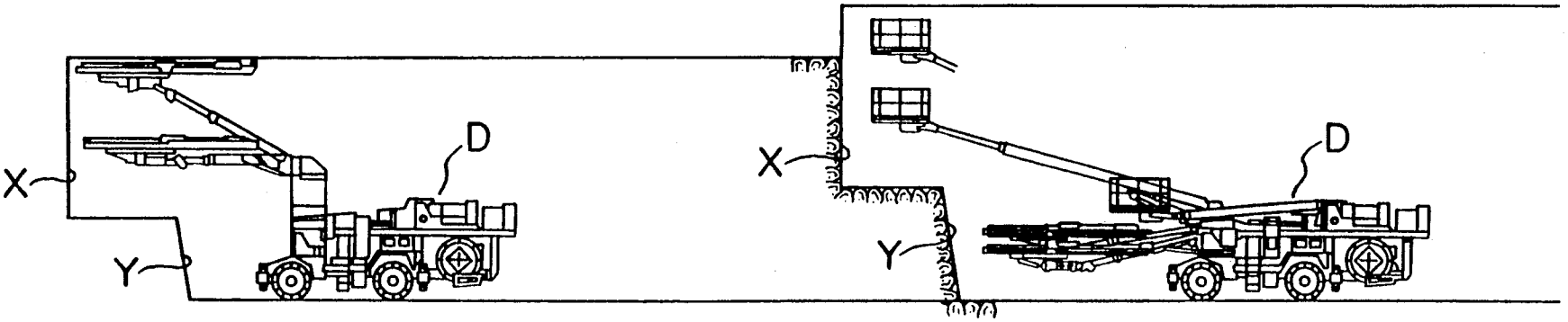
FIG. 36 is a side of FIG. 34.
Figure 37:
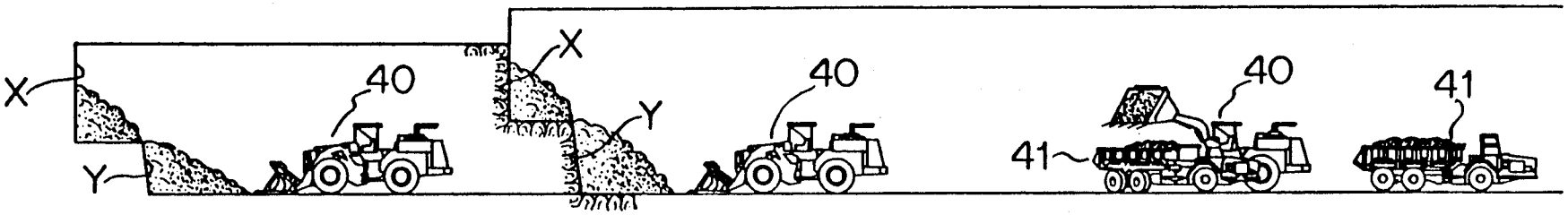
FIG. 37 is a side view showing mucking using a silot method.
Figure 38:
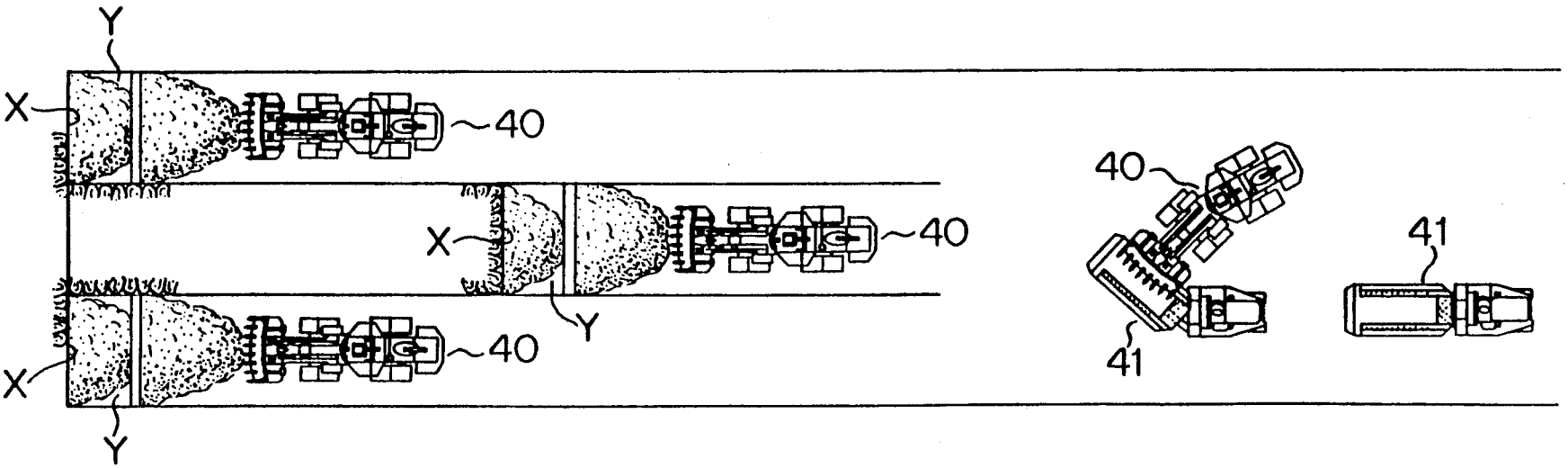
FIG. 38 is a top view of FIG. 37.
Figure 39:
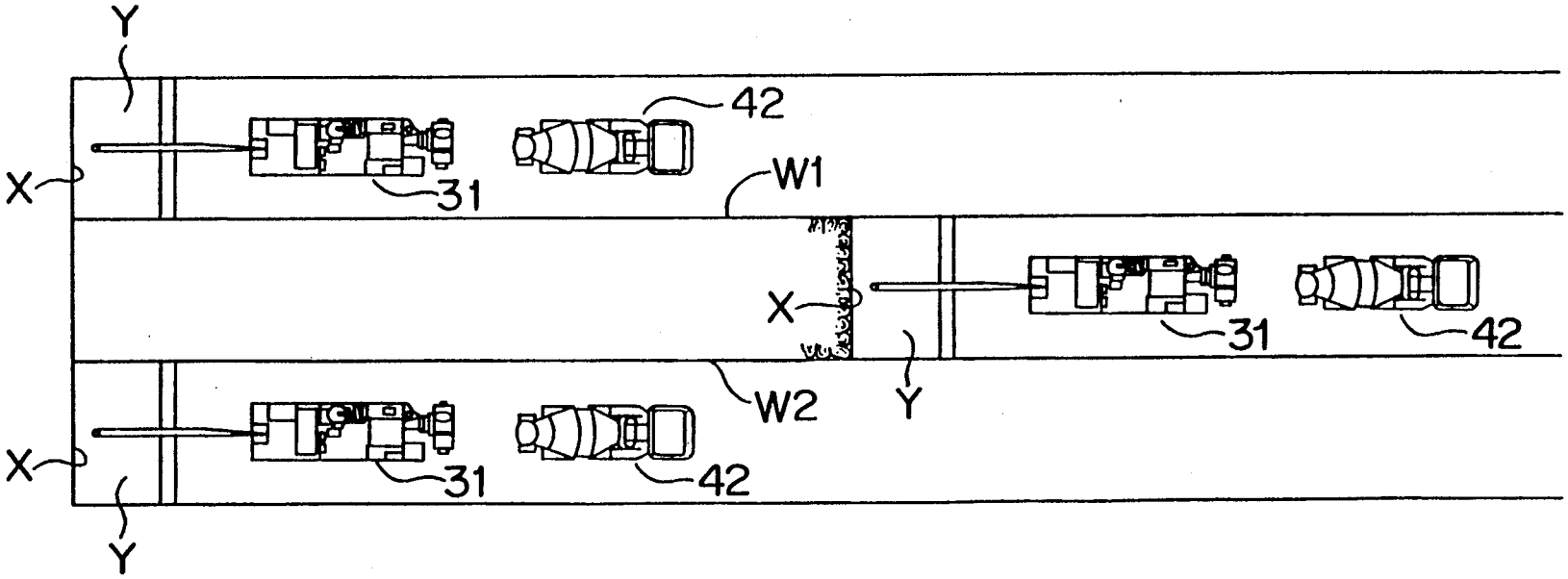
FIG. 39 is a plan view showing shooting using a silot method.
Figure 40:
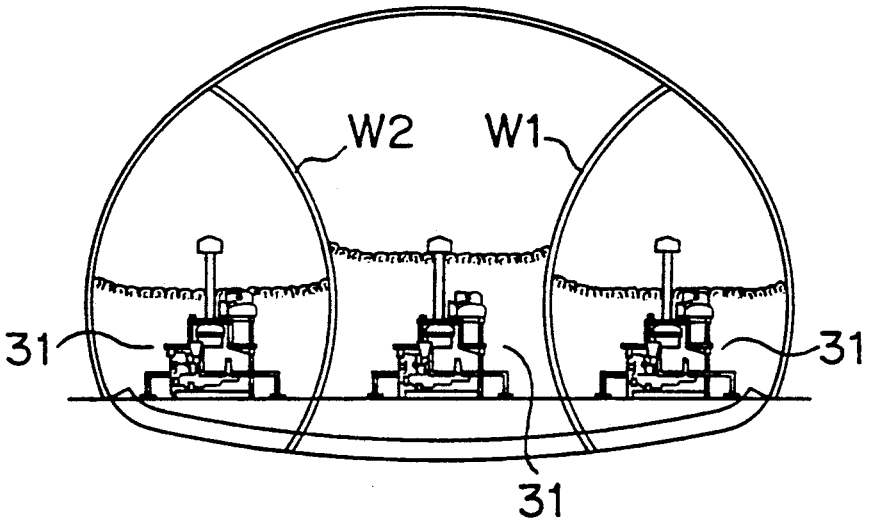
FIG. 40 is a front view of FIG. 39.
Figure 41:
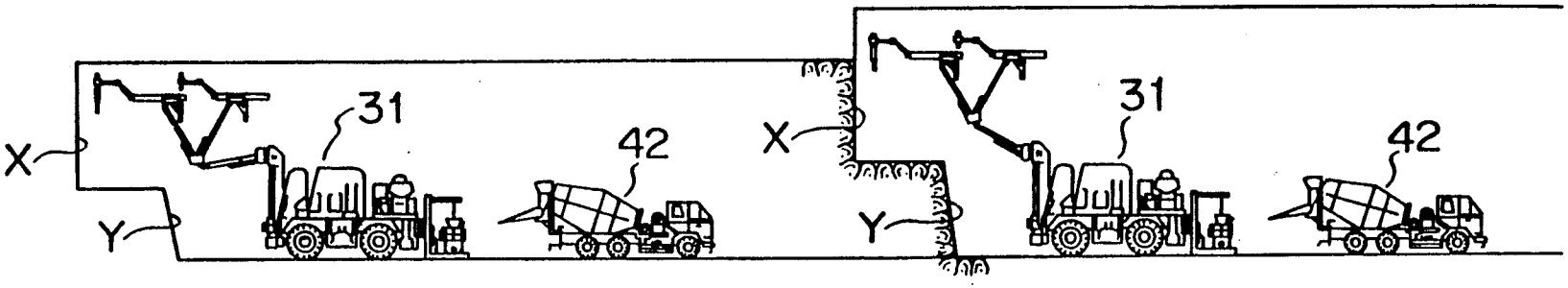
FIG. 41 is a side view of FIG. 40.
Figure 42:
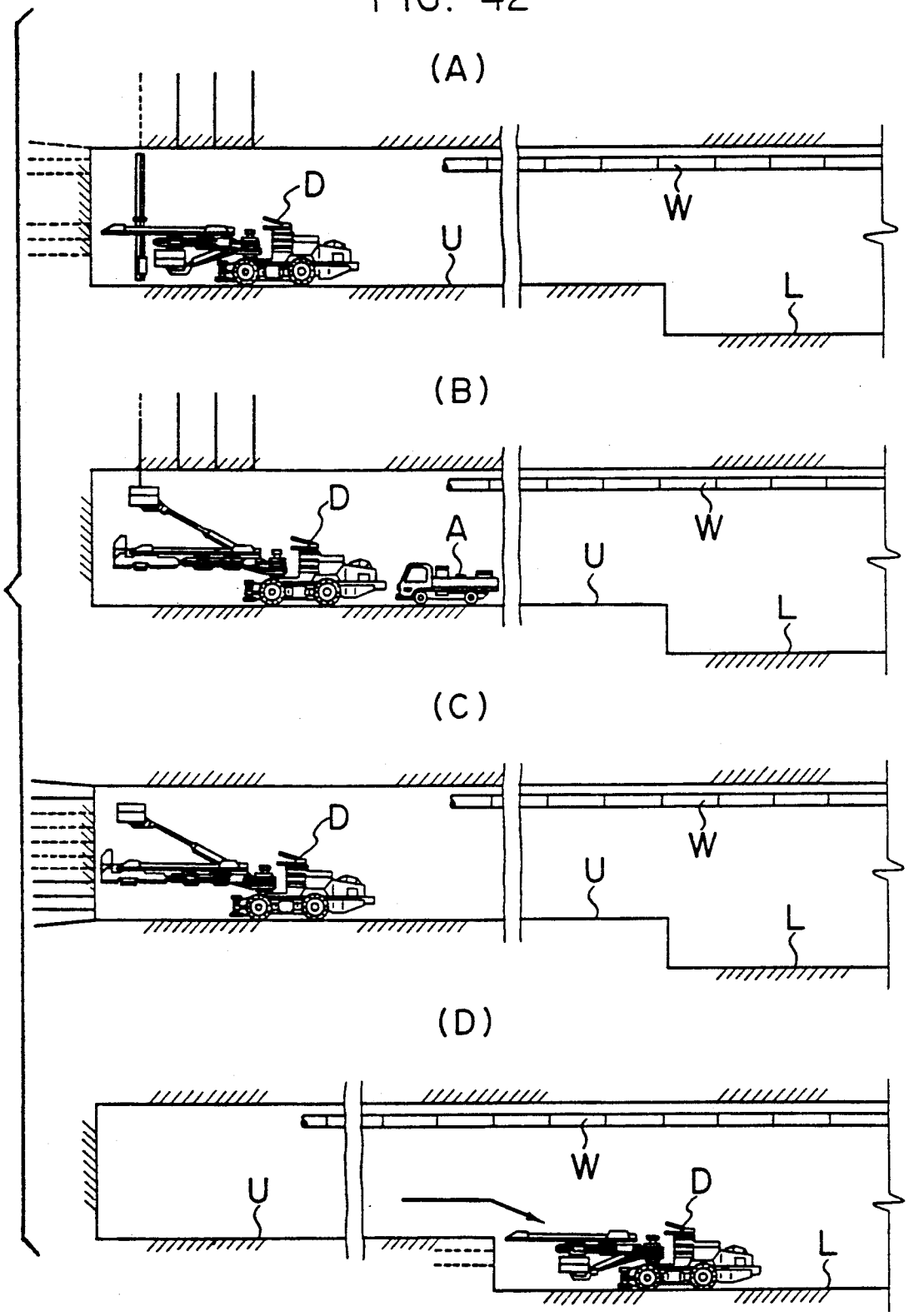
FIGS. 42 (A) to (D) are side views showing operation steps of the conventional tunnel driving method.

Drilling situation in silot method is shown in FIGS. 34 to 41. As shown in FIGS. 34 to 36, blasting holes and rock bolt holes are bored and rock bolts are inserted into the rock bolt holes. Mucking is shown in FIGS. 37 and 38. Shooting is shown in FIGS. 39 to 41. In this case, as shown in FIG. 34 clearly, operation in an out-side portion with respect to a wall W1 or a wall W2 is prefer to operation in a portion between the walls W1 and W2.

While preferred embodiments have been described, it is apparent that the present invention is not limited to the specific embodiments thereof.

What is claimed is:

1. A tunnel driving method comprising repetitions of continuous stages [(A) to (D)] of;

(A) placing single drill carriage, which is provided with at least two charging cages and at least two drill booms having drifters, at the center of a tunnel and before a short bench located at the foot of a facing in order that (A1) said two charging cages are moved toward an upper portion so as to mark blasting holes and rock bolt holes for said upper portion and (A2) said at least two drill booms are operated so as to bore said blasting holes and said rock bolt holes for said upper portion;

(B) moving said drill carriage backward with a predetermined length in order that (B1) said two charging cages are moved so as to insert rock bolts into said rock bolt holes for said upper portion, while said at least two drill booms are operated so as to bore blasting holes and rock bolt holes for a lower portion located under said bench and (B2) said two charging cages are operated so as to insert rock bolts into said rock bolt holes for said lower portion and so as to charge said blasting holes for said upper portion and said blasting holes for said lower portion with dynamite;

(C) blasting said upper portion and said lower portion so that said facing is broken and a new facing of said upper portion and a new facing of said lower portion are formed; and (D) carrying out after-treatments including concrete shooting.

2. A tunnel driving method comprising repetitions of continuous stages [(A) to (D)] of;

(A) placing at least two drill carriages, each of which is provided with at least two charging cages and at least two drill booms having drifters, at the center of a tunnel and before a short bench located at the foot of a facing, under the condition that said drill carriages are operated for forward portions with respect to said drill carriages respectively in order that (A1) said two charging cages are moved toward an upper portion so as to mark blasting holes and rock bolt holes for said upper portion and (A2) said at least two drill booms are operated so as to bore said blasting holes and said rock bolt holes for said upper portion;

(B) moving said two drill carriages backward with a predetermined length, under said condition that said drill carriages are operated for said forward portions with respect to said drill carriages respectively in order that (B1) said two charging cages are moved so as to insert rock bolts into said rock bolt holes for said upper portion, while said at least two drill booms are operated so as to bore blasting holes and rock bolt holes for a lower portion located under said bench and (B2) said two charging cages are operated so as to insert rock bolts into said rock bolt holes for said lower portion and so as to charge said blasting holes for said upper portion and said blasting holes for said lower portion with dynamite;

(C) blasting said upper portion and said lower portion so that said facing is broken and a new facing of said upper portion and a new facing of said lower portion are formed, under said condition that said drill carriages are operated for said forward portions with respect to said drill carriages respectively; and (D) carrying out after-treatments including concrete shooting.

3. A tunnel driving method comprising parallel repetitions of two groups [(A) to (D) and (E) to (G)] of continuous stages of;

(A) placing at least two drill carriages, each of which is provided with at least two charging cages and at least two drill booms having drifters, at the center of a tunnel and before a short bench located at the foot of a facing in order that (A1) said two charging cages are moved toward an upper portion so as to mark blasting holes and rock bolt holes for said upper portion and (A2) said at least two drill booms are operated so as to bore said blasting holes and said rock bolt holes for said upper portion;

(B) moving said two drill carriages backward with a predetermined length in order that (B1) said two charging cages are moved so as to insert rock bolts into said rock bolt holes for said upper portion, while said two drill booms are operated for a third enlargement other than lower side enlargements so as to bore blasting holes for said third enlargement and (B2) said two charging cages are operated so as to charge said blasting holes for said upper portion and said blasting holes for said third enlargement with dynamite;

(C) blasting said upper portion and said third enlargement so that said facing is broken and a new facing of said upper portion and a new facing of said third enlargement are formed; and (D) carrying out after-treatments including concrete shooting; and (E) placing another drill carriage or a machine provided with at least a charging cage and a drill boom before said lower side enlargements so as to bore blasting holes for said lower side enlargements and rock bolt holes on the side walls of said lower side enlargements, inserting rock bolts into said rock bolt holes and charging said blasting holes with dynamite, while said two charging cages are operated so as to charge said blasting holes for said upper portion and said blasting holes for said third enlargement with said dynamite [(B2)];

(F) moving said other drill carriage or said machine away from said lower side enlargements so as to blast said lower side enlargements, when said upper portion and said third enlargement are blasted so that said facing is broken and said new facing of said upper portion and said new facing of said third enlargement are formed [(C)]; and (G) carrying out after-treatments including concrete shooting.

4. A tunnel driving method comprising parallel repetitions of two groups [(A) to (D) and (E)] of continuous stages of;

(A) placing at least two drill carriages, each of which is provided with at least two charging cages and at least two drill booms having drifters, at the center of a tunnel and before a short bench located at the foot of a facing in order that (A1) said two charging cages are moved toward an upper portion so as to mark blasting holes and rock bolt holes for said upper portion and (A2) said at least two drill booms are operated so as to bore said blasting holes and said rock bolt holes for said upper portion;

(B) moving said two drill carriages backward with a predetermined length in order that (B1) said two charging cages are moved so as to insert rock bolts into said rock bolt holes for said upper portion, while said two drill booms are operated for a third enlargement other than lower side enlargements so as to bore blasting holes for said third enlargement and (B2) said two charging cages are operated so as to charge said blasting holes for said upper portion and said blasting holes for said third enlargement with dynamite;

(C) blasting said upper portion and said third enlargement so that said facing is broken and a new facing of said upper portion and a new facing of said third enlargement are formed; and (D) carrying out after-treatments including concrete shooting; and (E) placing another drill carriage or a machine provided with at least a charging cage and a drill boom before said lower side enlargements so as to bore blasting holes for said lower side enlargements and rock bolt holes on the side walls of said lower side enlargements, inserting rock bolts into said rock bolt holes, charging said blasting holes with dynamite, moving said other drill carriage or said machine away from said lower side enlargements so as to blast said lower side enlargements and carrying out after-treatments including concrete shooting, when concrete shooting is started in said upper portion and said third enlargements [(D)] after blasting said upper portion and said third enlargement so that said facing is broken and said new facing of said upper portion and said new facing of said third enlargement are formed [(C)].

5. A tunnel driving method comprising parallel repetitions of two groups [(A) to (D) and (E)] of continuous stages of;

(A) placing at least two drill carriages, which are provided with at least two charging cages and at least two drill booms having drifters, at the center of a tunnel and before a short bench located at the foot of a facing in order that (A1) said two charging cages are moved toward an upper portion so as to mark blasting holes and rock bolt holes for said upper portion and (A2) said at least two drill booms are operated so as to bore said blasting holes and said rock bolt holes for said upper portion;

(B) moving said two drill carriages backward with a predetermined length in order that (B1) said two charging cages are moved so as to insert rock bolts into said rock bolt holes for said upper portion, while said two drill booms are operated for a third enlargement other than lower side enlargements so as to bore blasting holes for said third enlargement and (B2) said two charging cages are operated so as to charge said blasting holes for said upper portion and said blasting holes for said third enlargement with dynamite;

(C) blasting said upper portion and said third enlargement so that said facing is broken and a new facing of said upper portion and a new facing of said third enlargement are formed; and (D) carrying out after-treatments including concrete shooting; and (E) placing said two drill carriages before said lower side enlargements so as to bore blasting holes of lower side enlargements and rock bolt holes of the side walls of said lower side enlargements, inserting rock bolts into said rock bolt holes, charging said blasting holes with dynamite, moving said two drill carriages away from said lower side enlargements so as to blast said lower side enlargements and carrying out after-treatments including concrete shooting, when concrete shooting is started in said upper portion and said third enlargement [(D)] after blasting said upper portion and said third enlargement so that said facing is broken and said new facing of said upper portion and said new facing of said third enlargement are formed [(C)].

* * * * *